United States Patent [19]

Caswell et al.

[11] Patent Number: 5,019,280

[45] **Date of Patent: * May 28, 1991**

[54] ION-PAIR COMPLEX CONDITIONING AGENT WITH BENZENE SULFONATE/ALKYL BENZENE SULFONATE ANIONIC COMPONENT AND COMPOSITIONS CONTAINING SAME

[75] Inventors: Debra S. Caswell; Mark H. Mao; Robert Mermelstein; Ellen S. Baker, all of Cincinnati, Ohio

[73] Assignee: The Procter & Gamble Company, Cincinnati, Ohio

[ * ] Notice: The portion of the term of this patent subsequent to Apr. 10, 2007 has been disclaimed.

[21] Appl. No.: 308,353

[22] Filed: Feb. 8, 1989

Related U.S. Application Data

[63] Continuation-in-part of Ser. No. 108,838, Oct. 15, 1981, Pat. No. 4,915,854, which is a continuation-in-part of Ser. No. 930,840, Nov. 14, 1986, abandoned.

[51] Int. Cl.[5] ..... D06M 13/34

[52] U.S. Cl. ..... 252/8.8; 252/528; 252/545; 252/547

[58] Field of Search ..... 252/8.8, 528, 545, 547

[56] References Cited

U.S. PATENT DOCUMENTS

| | | | |
|---|---|---|---|
| 2,691,636 | 10/1954 | Stayner et al. | 252/152 |
| 3,005,777 | 9/1962 | Terry | 252/152 |
| 3,686,025 | 8/1972 | Morton | 117/140 R |
| 3,696,056 | 10/1972 | Inamorato | 252/525 |
| 3,812,044 | 5/1974 | Connor et al. | 252/89 |
| 3,886,075 | 5/1975 | Bernardino | 252/8.75 |
| 3,904,533 | 9/1975 | Neiditch et al. | 252/8.8 |
| 3,936,537 | 2/1976 | Baskerville, Jr. et al. | 427/242 |
| 3,959,155 | 5/1976 | Montgomery et al. | 252/8.8 |
| 4,049,858 | 9/1977 | Murphy | 428/136 |
| 4,058,489 | 11/1977 | Hellsten | 252/547 |
| 4,095,946 | 6/1978 | Jones et al. | 8/137 |
| 4,108,600 | 8/1978 | Wong | 8/137 |
| 4,173,539 | 11/1979 | Rule et al. | 252/8.8 |
| 4,272,386 | 6/1981 | Draper et al. | 252/8.6 |
| 4,292,035 | 9/1981 | Battrell | 8/137 |
| 4,294,710 | 10/1981 | Hardy et al. | 252/8.8 |
| 4,303,543 | 12/1981 | Mansy | 252/117 |
| 4,375,416 | 3/1983 | Crisp et al. | 252/8.7 |
| 4,514,444 | 4/1986 | Ives et al. | 427/242 |
| 4,557,853 | 8/1984 | Collins | 252/128 |
| 4,597,898 | 7/1986 | Vander Meer | 252/529 |
| 4,638,907 | 1/1987 | Bedenk et al. | 206/0.5 |
| 4,661,267 | 4/1987 | Dekker et al. | 252/8.8 |
| 4,661,269 | 4/1987 | Trinh et al. | 252/8.8 |
| 4,786,369 | 11/1988 | Kanfer | 252/120 |

FOREIGN PATENT DOCUMENTS

| | | |
|---|---|---|
| 818419 | 7/1969 | Canada . |
| 1186458 | 5/1985 | Canada . |
| 133804 | 6/1985 | European Pat. Off. . |
| 1077103 | 7/1967 | United Kingdom . |
| 1077104 | 7/1967 | United Kingdom . |
| 1230792 | 5/1971 | United Kingdom . |
| 1565808 | 9/1976 | United Kingdom . |
| 1514276 | 6/1978 | United Kingdom . |

*Primary Examiner*—John F. Niebling
*Assistant Examiner*—Isabelle R. McAndrews
*Attorney, Agent, or Firm*—Leonard W. Lewis; Jerry J. Yetter; R. C. Witte

[57] ABSTRACT

Disclosed are conditioning agents and compositions containing such conditioning agents wherein the conditioning agents contain an amine-anionic compound ion-pair complex. These conditioning agents can provide excellent fabric care benefits when applied as part of or in the presence of detergent compositions without significantly impairing cleaning performance. The conditioning agents contain particles which consist essentially of the ion-pair complex and which have an average particle diameter of from about 40 to about 300 microns.

38 Claims, No Drawings

ION-PAIR COMPLEX CONDITIONING AGENT WITH BENZENE SULFONATE/ALKYL BENZENE SULFONATE ANIONIC COMPONENT AND COMPOSITIONS CONTAINING SAME

CROSS-REFERENCE TO PRIOR APPLICATIONS

This application is a continuation-in-part of application Ser. No. 108,838, filed Oct. 15, 1987, U.S. Pat. No. 4,915,854, which is a continuation-in-part of application Ser. No. 930,840, filed Nov. 14, 1986, now abandoned.

TECHNICAL FIELD

This invention relates to fabric conditioning agents and also to detergent compositions containing these fabric conditioning agents.

BACKGROUND OF THE INVENTION

Numerous attempts have been made to formulate laundry detergent compositions which provide the good cleaning performance expected of them and which also have good fabric softening and anti-static properties. Attempts have been made to incorporate cationic fabric softeners in anionic surfactant-based built detergent compositions employing various means of overcoming the natural antagonism between the anionic and cationic surfactants. For instance, Baskerville et al. U.S. Pat. No. 3,936,537, issued Feb. 3, 1976, discloses detergent compositions comprising organic surfactant, builders, and, in particulate form (10 to 500 microns), a quaternary ammonium softener combined with a poorly water-soluble dispersion inhibitor which inhibits premature dispersion of the cationic in the wash liquor. Even in these compositions some compromise between cleaning and softening effectiveness has to be accepted. Another approach to provide detergent compositions with softening ability has been to employ nonionic surfactants (instead of anionic surfactants) with cationic softeners. Compositions of this type have been described in, for example, German Patent 1,220,956, assigned to Henkel, issued Apr. 4, 1964; and in Salmen et al. U.S. Pat. No. 3,607,763, issued Sept. 21, 1971. However, the detergency benefits of nonionic surfactants are inferior to those of anionic surfactants.

Other laundry detergent compositions have employed tertiary amines along with anionic surfactants to act as fabric softeners. British Patent 1,514,276, Kengon, published June 14, 1978, employs certain tertiary amines with two long chain alkyl or alkenyl groups and one short chain alkyl group. These amines are useful as fabric softeners in detergent compositions when their isoelectric point is such that they are present as a dispersion of negatively charged droplets in the normally alkaline wash liquor, and in a more cationic form at the lower pH of a rinse liquor, and so becomes substantive to fabrics. The use of such amines, among others, in detergent compositions has also been previously disclosed in British Patent 1,286,054, assigned to Colgate-Palmolive, published Aug. 16, 1972, British Patent 1,514,276, assigned to Unilever, published June 14, 1978, and in Crisp et al. U.S. Pat. No. 4,375,416, issued Mar. 1, 1983.

British Patent Applications 1,077,103 and 1,077,104, assigned to Bayer, published July 26, 1967, disclose amine-anionic surfactant ion-pair complexes useful as antistatic agents. These complexes are applied directly to the fabric from an aqueous carrier. There is no suggestion in either of these references that such complexes could be added to detergent compositions to impart fabric conditioning benefits through-the-wash. Such complexes are delivered in solubilized form and therefore would not be retained by the fabrics past the rinse stage of an automatic washing machine.

Fatty acid-amine ion-pair complexes in granular detergents are disclosed in European Patent Application 133,804, Burckett-St.Laurent et al., published June 3, 1985. While this complex delivers fabric softening benefits, the alkyl amine-anionic surfactant ion-pair complexes of the present invention provide superior antistatic performance.

It is an object of the present invention to provide a conditioning agent which can be used through-the-wash (i.e., can be added to the wash prior to initiation of the rinse cycle) and provide excellent fabric conditioning benefits, including static control and fabric softening, without significantly impairing the cleaning performance of detergent or other cleaning compositions. It is also an obJect of this invention to provide fabric conditioning compositions, in both liquid and granular forms, which can be used through-the wash and provide fabric softening an excellent static control benefits without significantly impairing the cleaning performance of detergent or other cleaning compositions, that is also added prior to the rinse cycle. (As used above, the term "fabric conditioning composition" refers to compositions containing at least one conditioning agent useful for fabric care, but not containing a significant amount of fabric cleaning ingredients.)

It is another object of this invention to provide a liquid detergent composition having a conditioning agent which provides excellent through-the-wash fabric static control and fabric softening without significantly impairing cleaning performance. (The term "detergent composition", as used above refers to compositions containing at least one conditioning agent useful for fabric care and also containing one or more fabric cleaning ingredients).

It is yet another object of this invention to provide a granular detergent compositions having a fabric conditioner which provides excellent through-the-wash static control and fabric softening without significantly impairing cleaning performance.

SUMMARY OF THE INVENTION

The present invention relates to conditioning agents comprising:

from about 0.1% to about 20% of water-insoluble particles having an average diameter of from about 40 to about 300 microns, comprising a protonated amine-anionic compound ion-pair complex having the formula:

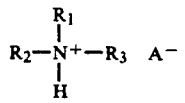

wherein each $R_1$ and $R_2$ can independently be $C_{12}$ to $C_{20}$ alkyl or alkenyl, $R_3$ is H or $CH_3$, and A- is an anionic compound selected from the group consisting of benzene sulfonates and $C_1$–$C_5$ linear alkyl benzene sulfonates, and mixtures thereof.

These conditioning agents can be incorporated into liquid and granular fabric conditioning and detergent compositions. The particles are particularly useful for providing static control to clothes which are dried in automatic laundry dryers. The particles also provide fabric softening benefits. Such detergent compositions can additionally contain detergent builders, chelating agents, enzymes, soil release agents, and other detergent components useful for fabric cleaning or conditioning applications.

DETAILED DESCRIPTION OF THE INVENTION

The conditioning agent, fabric care compositions, and detergent compositions of the present invention are described in detail below. As used herein, the term "fabric care composition" shall mean compositions containing the conditioning agent of the present invention and optionally containing other fabric conditioning components, but not containing significant amounts of fabric cleaning ingredients. The term "detergent composition" shall refer to compositions containing the conditioning agent of the present invention, optionally containing other fabric conditioning agents, and also containing one or more fabric cleaning ingredients.

Conditioning Agent

The conditioning agent of the present invention comprises water-insoluble particles having an average diameter of less than about 300 microns, preferably less than about 250 microns, more preferably less than about 200 microns and most preferably less than about 150 microns, and more than about 40 microns, preferably more than about 50 microns, most preferably more than about 60 microns. Said particles consist essentially of certain alkylamine anionic compound ion-pair complexes. These particles can be used directly or incorporated into fabric care compositions useful for through-the-wash fabric conditioning, and can also provide fabric conditioning when incorporated into laundry detergent compositions without significantly impairing cleaning performance. The conditioning agent particles of the present invention can also be used for rinse-added or dry-added fabric conditioning.

The ion-pair complexes can be represented by the following formula:

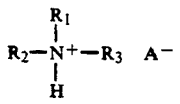

wherein each $R_1$ and $R_2$ can independently be $C_{12}$ to $C_{20}$ alkyl or alkenyl, and $R_3$ is H or $CH_3$. A- represents an anionic compound which is selected from the group consisting of benzene sulfonates and $C_1$–$C_5$ linear alkyl benzene sulfonates, and mixtures thereof.

As used herein the term linear alkyl benzene sulfonate shall include those compounds having a sulfonate moiety at a fixed, or predetermined, location along the carbon chain, as well as compounds having a sulfonate moiety at a random position along the alkyl chain.

These ion-pair complex particles should have an average particle diameter of from about 40 to about 300 microns. Preferably the particles have an average diameter of less than about 250 microns, more preferably less than about 200 microns, and most preferably less than about 150 microns. Also preferably, the particles have an average diameter of greater than about 50 microns, most preferably greater than about 60 microns. The term "average particle diameter" represents the mean particle size diameter of the actual particles of a given material. The mean is calculated on a weight percent basis. The mean is determined by conventional analytical techniques such as, for example, laser light diffraction or microscopic determination utilizing a scanning electron microscope. Preferably, greater than 50% by weight, more preferably greater than 60% by weight, and most preferably greater than 70% by weight, of the particles have actual diameters which are less than about 300 microns, preferably less than about 250 microns, more preferably less than about 200 microns, and most preferably less than about 150 microns. Also preferably, greater than 50% by weight, more preferably greater than 60% by weight, and most preferably greater than 70% by weight, of the particles have actual diameters which are greater than about 40 microns, preferably greater than about 50 microns, most preferably greater than about 60 microns.

Starting alkylamines are of the formula:

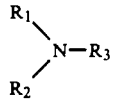

wherein each $R_1$ and $R_2$ are independently $C_{12}$ to $C_{20}$ alkyl or alkenyl, preferably $C_{16}$ to $C_{18}$ alkyl or alkenyl, and most preferably $C_{16}$ to $C_{18}$ alkyl, and $R_3$ is H or $CH_3$, preferably H. Suitable non-limiting examples of starting amines include hydrogenated ditallow amine, hydrogenated ditallow methyl amine, unhydrogenated ditallow amine, unhydrogenated ditallow methyl amine, dipalmityl amine, dipalmityl methyl amine, distearyl amine, distearyl methyl amine, diarachidyl amine, diarachidyl methyl amine, palmityl stearyl amine, palmityl stearyl methyl amine, palmityl arachidyl amine, palmityl arachidyl methyl amine, stearyl arachidyl amine, and stearyl arachidyl methyl amine. Most preferred are hydrogenated ditallow and distearyl amine.

The anionic compounds ($A^-$) useful in the ion-pair complex of the present invention include benzene sulfonates and $C_1$–$C_5$ linear alkyl benzene sulfonates (LAS) particularly $C_1$–$C_3$ LAS. Most preferred is $C_3$ LAS. The benzene sulfonate moiety of LAS can be positioned at any carbon atom of the alkyl chain, and is commonly at the second atom for alkyl chains containing three or more carbon atoms.

The amines and anionic compounds listed above can generally be obtained from commercial chemical sources such as Aldrich Chemical Co., Inc. in Milwaukee, Wis., Vista Chemical Co. in Ponca, Okla., and Reutgers-Nease Chemical Co., in State College, Pa.

Non-limiting examples of ion-pair complexes suitable for use in the present invention include:

- ditallow amine (hydrogenated or unhydrogenated) complexed with a linear $C_1$–$C_5$ alkyl benzene sulfonate (LAS),
- ditallow methyl amine (hydrogenated or unhydrogenated) complexed with a $C_1$–$C_5$ LAS,
- dipalmityl amine complexed with a $C_1$–$C_5$ LAS,
- dipalmityl methyl amine complexed with a $C_1$–$C_5$ LAS,
- distearyl amine complexed with a $C_1$–$C_5$ LAS,
- distearyl methyl amine complexed with a $C_1$–$C_5$ LAS,
- diarachidyl amine complexed with a $C_1$–$C_5$ LAS,
- diarachidyl methyl amine complexed with a $C_1$–$C_5$ LAS, palmityl stearyl amine complexed with a $C_1$–$C_5$ LAS,
palmityl stearyl methyl amine complexed with a $C_1$–$C_5$ LAS,
palmityl arachidyl amine complexed with a $C_1$–$C_5$ LAS,
palmityl arachidyl methyl amine complexed with a $C_1$–$C_5$ LAS,
stearyl arachidyl amine complexed with a $C_1$–$C_5$ LAS,
stearyl arachidyl methyl amine complexed with a $C_1$–$C_5$ LAS,
ditallow amine (hydrogenated or unhydrogenated) complexed with a benzene sulfonate,
ditallow methyl amine (hydrogenated or unhydrogenated) complexed with a benzene sulfonate,
dipalmityl amine complexed with a benzene sulfonate,
dipalmityl methyl amine complexed with a benzene sulfonate,
distearyl amine complexed with a benzene sulfonate,
distearyl methyl amine complexed with a benzene sulfonate,
diarachidyl amine complexed with a benzene sulfonate,
diarachidyl methyl amine complexed with a benzene sulfonate,
palmityl stearyl amine complexed with a benzene sulfonate,
palmityl stearyl methyl amine complexed with a benzene sulfonate,
palmityl arachidyl amine complexed with a benzene sulfonate, and
palmityl arachidyl methyl amine complexed with a benzene sulfonate,
stearyl arachidyl amine complexed with a benzene sulfonate, and
stearyl arachidyl methyl amine complexed with a benzene sulfonate, and mixtures of these ion-pair complexes.

More preferred are complexes formed from the combination of ditallow amine (hydrogenated or unhydrogenated) complexed with a benzene sulfonate or $C_1$–$C_5$ linear alkyl benzene sulfonate and distearyl amine complexed with a benzene sulfonate or with a $C_1$–$C_5$ linear alkyl benzene sulfonate. Even more preferred are those complexes formed from hydrogenated ditallow amine or distearyl amine complexed with a $C_1$–$C_3$ linear alkyl benzene sulfonate (LAS). Most preferred are complexes formed from hydrogenated ditallow amine or distearyl amine complexed with $C_3$ linear alkyl benzene sulfonate.

The amine and anionic compound are combined in a molar ratio of amine to anionic compound ranging from about 10:1 to about 1:2, preferably from about 5:1 to about 1:2, more preferably from about 2:1 to 1:2 and most preferably 1:1. This can be accomplished by any of a variety of means, including but not limited to, preparing a melt of the anionic compound (in acid form) and the amine, and then processing to the desired particle size range.

Other specific methods of forming the ion-pair complex include: dissolving the components in an organic solvent or heating the amine to a liquid state and then adding this molten amine component to a heated acidified aqueous solution of the anionic compound, and then extracting the ion-pair complex by using a solvent, such as chloroform.

The complexing of the amine and the anionic compound results in an ion-pair entity which is chemically distinct from either of the two starting materials. Such factors as the type of amine and type of anionic compound employed and the ratio of amine to anionic compound can affect the physical properties of the resulting complex, including the thermal phase transition points which affects whether the complex has a gelatinous (soft) or crystalline (hard) character at a particular temperature. Thermal phase transition points are discussed in more detail below.

The desired particle sizes can be achieved by, for example, mechanically grinding the resulting ion-pair complex in blenders (e.g., an Oster® blender) or in large scale mills (e.g., a Wiley® Mill) to the desired particle size range. Preferably, the particles are formed by prilling in a conventional manner, such as by hydraulically forcing a comelt of the amine and anionic compound (in acid form) through a heated nozzle. Prior to passage through the nozzle, the comelt should be in a well-mixed condition, for example by continuously circulating the comelt through a loop at sufficient velocity to prevent settling. As an alternative to hydraulically forcing the comelt through the nozzle, air inJection can be used to pass the comelt through the nozzle. The particles that result from prilling are preferably spherical and particle diameters within the applicable and preferred ranges of this invention can be obtained. Complexes which are gelatinous (i.e., soft) at room temperature can be mechanically ground to achieve the desired particle size after flash freezing by using, for example, liquid nitrogen. The particles can then be incorporated into a liquid delivery system, such as a detergent base or an aqueous base useful for forming an aqueous dispersion of the particles. Alternately for liquid applications, the comelt can be added to the liquid delivery system, such as a detergent base, and then be formed into particles by high shear mixing.

The complexes can be characterized for the purposes of this invention by their thermal phase transition points. As used hereafter, the thermal phase transition (hereinafter alternately referred to as "transition point") shall mean the temperature at which the complex exhibits softening (solid to liquid crystal phase transition) or melting (solid to isotropic phase transition) whichever occurs first upon heating. The transition point temperatures can be determined by differential scanning colorimetry (DSC) and optical microscopy. The transition point of the complexes of the present invention will generally lie in the range of from about 20° C. to about 100° C. Ion-pair complexes made with $C_1$–$C_3$ LAS and benzene sulfonate (i.e., no alkyl chain) generally will have transition points in the range of about 30° C. to about 100° C. and tend to be crystalline (hard), and therefore be susceptible to prilling. The temperature ranges listed above are approximate in nature, and are not meant to necessarily exclude complexes outside of the listed ranges. Further, it should be understood that the particular amine of the ion-pair complex can affect the transition point. For example, for the same anionic compound, distearyl amines will form harder ion-pair complexes than ditallow amines, and ditallow amines will form harder ion-pair complexes than ditallow methyl amines.

The ideal particle made from an ion-pair complex is sufficiently large so as to become entrapped in fabrics during washing, and has a transition point which is low enough that at least a substantial part of the particle, preferably the entire particle, will soften or melt at conventional automatic laundry dryer temperatures, but not so low that it will melt during the fabric wash or rinse stages. Additionally, it is desirable that the anionic compound form a comelt which is sufficiently hard such that it can be formed into particles by prilling.

Preferred ion-pair complexes include those comprised of a hydrogenated ditallow amine or distearyl amine complexed with a $C_1$ to $C_5$ LAS or benzene sulfonate in a 1:1 molar ratio. These complexes have transition points generally between about 20° C. and about 100° C. Highly preferred complexes include hydrogenated ditallow amine or distearyl amine complexed with $C_1$–$C_3$ LAS which have transition points between about 30° C. and about 100° C. Most preferred are complexes of $C_3$ LAS and ditallow or distearyl amine which have first transition points between about 30° C. and about 70° C.

It has been found that these conditioning agents, unlike those of the prior art, can be incorporated into detergent compositions or used in the presence of detergent compositions with little, if any, detrimental effect on cleaning. These conditioning agents provide conditioning benefits across a variety of laundry conditions, including machine or hand washing followed by machine drying and also machine or hand washing followed by line drying. Additionally, these same conditioning agents can be used with a variety of surfactant systems.

The conditioning agents of the present invention are useful for imparting conditioning benefits from a variety of delivery systems. Suitable delivery systems for use include detergent compositions (including granular and liquid detergent compositions), fabric conditioning compositions (including granular and liquid fabric conditioning compositions) which comprise the fabric care agent of the present invention, and fabric care and/or detergent articles adapted to release particles of the ion-pair complexes of the present invention upon contact with and/or agitation of the article in water. As used herein, the term "granular composition" shall refer to any dry compositions which contain the conditioning agent particles of the present invention. This shall include the particles of the conditioning agent of the disclosed sizes in agglomerated form (discussed later) for use in granular (dry) detergents as well as the particles in unagglomerated form, especially useful for granular (dry) fabric conditioning compositions. The latter form can alternately be referred to as a powder composition.

While, as described above, the fabric care agent of the present invention may be utilized in dryer-added, wash-added, and rinse-added contexts, of particular benefit is the ability to use the fabric care agent of the present invention in the presence of detergent components without significantly decreasing cleaning performance.

The amine-anionic compound ion-pair complexes are typically used herein at levels of about 0.1% to about 20.0%, preferably 0.1% to about 10%, of a detergent composition with which the ion-pair complex is used in the presence of or is incorporated in. Detergent composition components are described below.

Detergent Surfactant

The amount of detergent surfactant included in detergent compositions of the present invention can vary from about 1% to about 98% by weight of the composition, depending upon the particular surfactant(s) used and the effects desired. Preferably, the detergent surfactant(s) comprises from about 10% to about 60% by weight of the composition. Combinations of anionic, cationic and nonionic surfactants can be used. Combinations of anionic and nonionic surfactants are preferred for liquid detergent compositions. Preferred anionic surfactants for liquid detergent compositions include linear alkyl benzene sulfonates, alkyl sulfates, and alkyl ethoxylated sulfates. Preferred nonionic surfactants include alkyl polyethoxylated alcohols.

Anionic surfactants are preferred for use as detergent surfactants in granular detergent compositions. Preferred anionic surfactants include linear alkyl benzene sulfonates and alkyl sulfates.

Other classes of surfactants, such as semi-polar, ampholytic, zwitterionic, or cationic surfactants can be used. Mixtures of these surfactants can also be used.

A. Nonionic Detergent Surfactants

Suitable nonionic detergent surfactants are generally disclosed in Laughlin et al. U.S. Pat. No. 3,929,678, issued Dec. 30, 1975, at column 13, line 14 through column 16, line 6, incorporated herein by reference. Classes of useful nonionic surfactants include:

1. The polyethylene oxide condensates of alkyl phenols. These compounds include the condensation products of alkyl phenols having an alkyl group containing from about 6 to about 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal TM CO-630, marketed by the GAF Corporation; and Triton TM X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 4 to about 10 moles of ethylene oxide per mole of alcohol. Examples of such ethoxylated alcohols include the condensation product of myristyl alcohol with about 10 moles of ethylene oxide per mole of alcohol; and the condensation product of coconut alcohol (a mixture of fatty alcohols with alkyl chains varying in length from 10 to 14 carbon atoms) with about 9 moles of ethylene oxide. Examples of commercially available nonionic surfactants of this type include Tergitol TM 15-S-9 (the condensation product of $C_{11}$–$C_{15}$ linear alcohol with 9 moles ethylene oxide), Tergitol TM 24-L-6 NMW (the condensation product of $C_{12}$–$C_{14}$ primary alcohol with 6 moles ethylene oxide with a narrow molecular weight distribution), both marketed by Union Carbide Corporation; Neodol TM 45-9 (the condensation product of $C_{14}$–$C_{15}$ linear alcohol with 9 moles of ethylene oxide), Neodol TM 23-6.5 (the condensation product of $C_{12}$–$C_{13}$ linear alcohol with 6.5 moles of ethylene oxide), Neodol TM 45-7 (the condensation product of $C_{14}$–$C_{15}$ linear alcohol with 7 moles of ethylene oxide), Neodol TM 45-4 (the condensation product of $C_{14}$–$C_{15}$ linear alcohol with 4 moles of ethylene oxide), marketed by Shell Chemical Company, and Kyro TM EOB (the condensation product of $C_{13}$–$C_{15}$ alcohol with 9 moles ethylene oxide), marketed by The Proctor & Gamble Company.

3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic TM surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic TM compounds, marketed by Wyandotte Chemical Corporation.

5. Semi-polar nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Preferred semi-polar nonionic detergent surfactants are the amine oxide surfactants having the formula $$R^3(OR^4)_xN(R^5)_2 \rightarrow O$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

Preferred amine oxide surfactants are $C_{10}$–$C_{18}$ alkyl dimethyl amine oxides and $C_8$–$C_{12}$ alkoxy ethyl dihydroxy ethyl amine oxides.

6. Alkylpolysaccharides disclosed in Llenado U.S. Pat. No. 4,565,647, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.5 to about 10, preferably from about 1.5 to about 3, most preferably from about 1.6 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

7. Fatty acid amide surfactants having the formula:

$$R^6-\overset{\overset{\displaystyle O}{\|}}{C}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and —$(C_2H_4O)_xH$ where x varies from about 1 to about 3.

Preferred amides are $C_8$–$C_{20}$ ammonia amides, monoethanolamides, diethanolamides, and isopropanolamides.

B. Anionic Detergent Surfactants

Consistent with the art pertaining to detergent surfactants, granular detergents typically incorporate salt forms of the surfactants hereunder disclosed, whereas liquid detergents typically incorporate stable acid forms of the surfactants.

Anionic detergent surfactants suitable for use in the present invention as detergent surfactants include sulfates and sulfonates such as those generally disclosed in Laughlin et al. U.S. Pat. No. 3,929,678, issued Dec. 30, 1975, at column 23, line 58 through column 29, line 23 and in Hardy et al. U.S. Pat. No. 4,294,710, issued Oct. 13, 1981, both of which are incorporated herein by reference. Classes of useful anionic surfactants include:

1. Ordinary alkali metal soaps, such as the sodium, potassium, ammonium and alkylolammonium salts of higher fatty acids containing from about 8 to about 24 carbon atoms, preferably from about 10 to about 20 carbon atoms. Preferred alkali metal soaps are sodium laurate, sodium stearate, sodium oleate and potassium palmitate.

2. Water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.)

Examples of this group of anionic surfactants are the sodium and potassium alkylbenzene sulfonates in which the alkyl group contains from about 9 to about 15 carbon atoms, in straight chain or branched chain configuration, e.g., those of the type described in Guenther et al. U.S. Pat. No. 2,220,099, issued Nov. 5, 1940, and Lewis U.S. Pat. No. 2,477,383, issued Dec. 26, 1946. Especially useful are linear straight chain alkylbenzene sulfonates in which the average number of carbon atoms in the alkyl group is from about 11 to about 13, abbreviated as $C_{11}$–$C_{13}$LAS.

Other anionic surfactants include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms.

Also included are water-soluble salts of esters of alphasulfonated fatty acids containing from about 6 to about 20 carbon atoms in the fatty acid group and from about 1 to about 10 carbon atoms in the ester group; water-soluble salts of 2-acyloxy-alkane-1-sulfonic acids containing from about 2 to about 9 carbon atoms in the acyl group and from about 9 to about 23 carbon atoms in the alkane moiety; alkyl sulfates (AS) containing from about 10 to about 20 carbon atoms in the alkyl group; sulfates such as those of the formula $RO(C_2OH_4O)_mSO_3M$, wherein R is a $C_{10}$–$C_{16}$ alkyl (preferred) or hydroxyalkyl group, m is from about 0.5 to about 4, and M is a compatible cation water-soluble salts of olefin sulfonates containing from about 12 to about 24 carbon atoms; and beta-alkyloxy alkane sulfonates containing from about 1 to about 3 carbon atoms in the alkyl group and from about 8 to about 20 carbon atoms in the alkane moiety. Useful alkylether sulfates are described in detail in Hughes U.S. Pat. No. 4,807,219, issued Mar. 26, 1985, which is incorporated herein by reference. The above surfactant preferably represent from about 8% to about 18%, by weight (on an acid basis) of the composition, more preferably from about 9% to about 14%.

Preferred alkylethoxylated sulfate surfactants of the above formula are those wherein the R substituent is a $C_{12}$–$C_{15}$ alkyl group and m is from about 1.5 to about 3. Examples of such materials are $C_{12}$–$C_{15}$ alkyl polyethoxylate (2.25) sulfate ($C_{12-15}E_{2.25}S$); $C_{14-15}E_{2.25}S$; $C_{12-13}E_{1.5}S$: $C_{14-15}E_3S$; and mixtures thereof.

Particularly preferred surfactants for use in liquid detergent composition are linear $C_{11}$ to $C_{13}$ alkyl benzene sulfonates, alkyl sulfates, and alkylethoxylated sulfates (anionic) and $C_{12}$ to $C_{13}$ alkyl polyethoxylated alcohols (nonionic) and mixtures thereof. Liquid detergent compositions which contain alkyl and/or alkylethoxylated sulfates as detergent surfactants preferably comprise no more than about 5% of such detergent surfactants, and the anionic compound of the ion-pair complex is most preferably a $C_1$–$C_3$ LAS or benzene sulfonate. Particularly preferred surfactants for use in granular detergents are the linear $C_{11}$–$C_{13}$ alkyl benzene sulfonates and the $C_8$–$C_{18}$ alkyl sulfates and mixtures thereof. Most preferred are mixtures of these two anionic surfactants in a weight ratio of linear alkyl benzene sulfonate to alkyl sulfate is from about 0.5:1 to about 1 and more preferably from about 0.5:1 to about 2:1.

3. Anionic phosphate surfactants.

4. N-alkyl substituted succinamates.

C. Ampholytic Surfactants

Ampholytic surfactants can be broadly described as aliphatic derivatives of secondary or tertiary amines, or aliphatic derivatives of heterocyclic secondary and tertiary amines in which the aliphatic radical can be straight or branched chain and wherein one of the aliphatic substituents contains from about 18 carbon atoms and at least one of the aliphatic substituents contains an anionic water-solubilizing group, e.g., carboxy, sulfonate, sulfate. See Laughlin et al. U.S. Pat. No. 3,929,678, issued Dec. 30, 1975, column 19, line 38 through column 22, line 48, incorporated herein by reference, for examples of ampholytic surfactants useful herein.

D. Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. See Laughlin et al. U.S. Pat. No. 3,929,678, issued Dec. 30, 1975,column 19, line 38 through column 22, line 48, incorporated herein by reference, for examples of zwitterionic surfactants useful herein.

E. Cationic Surfactants

Cationic surfactants are the least preferred detergent surfactants useful in detergent compositions of the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solutions pH values less than about 8.5.

Suitable cationic surfactants include the quaternary ammonium surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is independently selected from the group consisting of $-CH_2CH_2-$, $-CH_2CH(CH_3)-$, $-CH_2CH(CH_2OH)-$, and $-CH_2CH_2CH_2-$; each $R^4$ is independently selected from the group consisting of $C_1$-$C_4$ alkyl, $C_1$-$C_4$ hydroxyalkyl, benzyl, ring structures formed by joining the two $R^4$ groups, $-CH_2CHOHCHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred examples of the above compounds are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate $C_8$-$C_{16}$ alkyl trimethylammonium salts, $C_8$-$C_{16}$ alkyl di(hydroxyethyl)methylammonium salts, the $C_8$-$C_{16}$ alkyl hydroxyethyldimethylammonium salts, and $C_8$-$C_{16}$ alkyloxypropyltrimethylammonium salts. Of the above, decyl trimethylammonium methylsulfate, lauryl trimethylammonium chloride, myristyl trimethylammonium bromide and coconut trimethylammonium chloride and methylsulfate are particularly preferred.

A more complete disclosure of these and other cationic surfactants useful herein can be found in Cambre U.S. Pat. No. 4,228,044, issued Oct. 14, 1980, incorporated herein by reference.

Detergent Builders

Detergent compositions of the present invention can contain inorganic and/or organic detergent builders to assist in mineral hardness control. These builders comprise from 0% to about 80% by weight of the compositions. Liquid formulations preferably comprise from about 5% to about 50%, more preferably about 5% to about 30%, by weight of detergent builder. Granular formulations preferably comprise from about 10% to about 80%, more preferably from about 24% to about 80% by weight of the detergent builder.

Useful water-soluble organic builders for granular and liquid compositions include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citrate. The citrate (preferably in the form of an alkali metal or alkanolammonium salt) is generally added to the composition as citric acid, but can be added in the form of a fully neutralized salt.

Highly preferred polycarboxylate builders are disclosed in Diehl U.S. Pat. No. 3,308,067, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates disclosed in Diehl U.S. Pat. No. 3,723,322, issued Mar. 28, 1973, incorporated herein by reference.

A class of useful phosphorus-free detergent builder materials have been found to be ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al, U.S. Pat. No. 3,635,830, issued Jan. 18, 1972, both of which are incorporated herein by reference.

A specific type of ether polycarboxylates useful as builders in the present invention are those having the general formula:

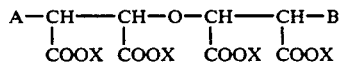

wherein A is H or OH; B is H or $-O-CH(COOX)-CH_2(COOX)$; and

X is H or a salt-forming cation. For example, if in the above general formula A and B are both H, then the compound is oxydisuccinic acid and its water-soluble salts. If A is OH and B is H, then the compound is tartrate monosuccinic acid (TMS) and its water-soluble salts. If A is H and B is

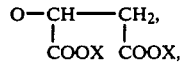

then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80. These builders are disclosed in U.S. Pat. No. 4,663,071, issued to Bush et al., on May 5, 1987.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

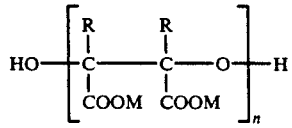

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Also suitable in the detergent compositions of the present invention are the 3,3-dicarboxy-4-oxa-1,6-hexanedioates and the related compounds disclosed in Bush U.S. Pat. No. 4,566,984, issued Jan. 28, 1986, incorporated herein by reference. Other useful builders include the $C_5$–$C_{20}$ alkyl succinic acids and salts thereof. A particularly preferred compound of this type is dodecenylsuccinic acid.

Useful builders also include sodium and potassium carboxymethyloxymalonate, carboxymethyloxysuccinate, cis-cyclohexanehexacarboxylate, cis-cyclopentanetetracarboxylate phloroglucinol trisulfonate, water-soluble polyacrylates (having molecular weights of from about 2,000 to about 200,000, for example), and the copolymers of maleic anhydride with vinyl methyl ether or ethylene.

Other suitable polycarboxylates are the polyacetal carboxylates disclosed in Crutchfield et al. U.S. Pat. No. 4,144,226, issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Especially useful builders include alkyl succinates of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: lauryl succinate, myristyl succinate, palmityl succinate, 2-dodecenyl succinate (preferred), 2-pentadecenyl succinate, and the like.

Other useful detergency builder materials are the "seeded builder" compositions disclosed in Belgian Patent 798,856, published Oct. 29, 1973, incorporated herein by reference. Specific examples of such seeded builder mixtures are 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

Other detergency builders useful in the present invention, primarily for granular detergent compositions, include the alkali metal silicates, alkali metal carbonates, phosphates, polyphosphates, phosphonates, polyphosphonic acids, $C_{10-18}$ alkyl monocarboxylic acids, polycarboxylic acids, alkali metal, ammonium or substituted ammonium salts thereof and mixtures thereof. The most preferred builders of this type for use in granular detergent compositions of the present invention are the alkali metal, especially sodium, salts of these compounds.

Still other preferred detergent builders for granular detergent compositions include crystalline aluminosilicate ion exchange materials having the formula:

$$Na_z[(AlO_2)_z(SiO_2)_y].xH_2O$$

wherein z and y are at least about 6, the mole ratio of z to y is from about 1.0 to about 0.5; and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate.

The aluminosilicate ion exchange builder materials are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The preferred crystalline aluminosilicate ion exchange materials are further characterized by a particle size diameter of from about 0.1 micron to about 10 microns. Amorphous materials are often smaller, e.g., down to less than about 0.01 micron. More preferred ion exchange materials have a particle size diameter of from about 0.2 micron to about 4 microns. The crystalline aluminosilicate ion exchange materials are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicates for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_{3/g}$. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Useful aluminosilicate ion exchange materials are commercially available. These aluminosilicates can be crystalline or amorphous in structure and can be naturally-occurring aluminosilicates of synthetically derived. A method for producing aluminosilicate ion exchange materials is disclosed in Krummel, et al. U.S. Pat. No. 3,985,669, issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27.

Specific examples of inorganic phosphate builders are sodium and potassium tripolyphosphate, pyrophosphate, polymeric metaphate having a degree of polymerization of from about 6 to about 21, and orthophosphate. Examples of polyphosphonate builders are the sodium and potassium salts of ethylene-1,1-diphosphonic acid, the sodium and potassium salts of ethane 1-hydroxy-1,1-diphosphonic acid and the sodium and potassium salts of ethane-1,1,2-triphosphonic acid. Other suitable phosphorus builder compounds are disclosed in Diehl U.S. Pat. No. 3,159,581, issued Dec. 1. 1964; Diehl U.S. Pat. No. 3,213,030, Oct. 19, 1965; Quimby U.S. Pat. No. 3,400,148, issued Sept. 3, 1968; Quimby U.S. Pat. No. 3,400,176, issued Sept. 3, 1968; Roy U.S. Pat. No. 3,422,021, issued Jan. 14, 1969; and Quimby U.S. Pat. No. 3,422,137, issued Sept. 3, 1968; all herein incorporated by reference.

Examples of nonphosphorus, inorganic builders are sodium and potassium carbonate, bicarbonate, sesquicarbonate, tetraborate decahydrate, and silicate having a mole ratio of $SiO_2$ to alkali metal oxide of from about 0.5 to about 4.0, preferably from about 1.0 to about 2.4

Monocarboxylic (fatty) acids, and salts thereof, such as the $C_1$–$C_{18}$ alkyl monocarboxylic acids (and salts thereof), can have a detrimental effect upon ion-pair complex stability in liquid compositions and are preferably either not present in amounts which significantly affect antistatic performance of the ion-pair complex particles, or if present, the ion-pair complex is stabilized such as by the presence of alkyl sulfonates or alkyl ethoxylated sulfonates (typically, but not necessarily, in amounts ranging from 5% to 40%, by weight, of the composition) or by other chemical stabilizing means or physical stabilizing means (such as by mixing or coating the particles with a nonexclusive wax).

Chelating Agents

The detergent compositions herein may also optionally contain one or more iron and manganese chelating agents. Such chelating agents can be selected from the group consisting of amino carboxylates, amino phosphonates, polyfunctionally - substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents in compositions of the invention have one or more, preferably at least two, units of the substructure

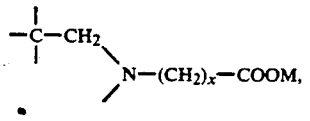

wherein M is hydrogen, alkali metal, ammonium or substituted ammonium (e.g. ethanolamine) and x is from 1 to about 3, preferably 1. Preferably, these amino carboxylates do not contain alkyl or alkenyl groups with more than about 6 carbon atoms. Operable amine carboxylates include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, and ethanoldiglycines, alkali metal, ammonium, and substituted ammonium salts thereof and mixtures thereof.

Amino phosphonates are also suitable for use as chelating agents in the compositions of the invention when at least low levels of total phosphorus are permitted in detergent compositions. Compounds with one or more, preferably at least two, units of the substructure

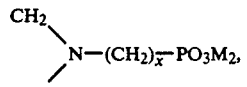

wherein M is hydrogen, alkali metal, ammonium or substituted ammonium and x is from 1 to about 3, preferably 1, are useful and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms. Alkylene groups can be shared by substructures.

Polyfunctionally - substituted aromatic chelating agents are also useful in the compositions herein. These materials comprise compounds having the general formula

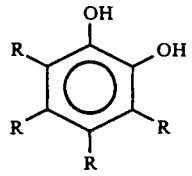

wherein at least one R is —$SO_3H$ or —COOH or soluble salts thereof and mixtures thereof. Connor et al. U.S. Pat. No. 3,812,044, issued May 21, 1974, incorporated herein by reference, discloses polyfunctionally - substituted aromatic chelating and sequestering agents. Preferred compounds of this type in acid form are dihydroxydisulfobenzenes and 1,2-dihydroxy -3,5-disulfobenzene or other disulfonated catechols in particular. Alkaline detergent compositions can contain these materials in the form of alkali metal, ammonium or substituted ammonium (e.g. mono-or triethanol-amine) salts.

If utilized, these chelating agents will generally comprise from about 0.1% to about 10% by weight of the detergent compositions herein. More preferably chelating agents will comprise from about 0.1% to about 3.0% by weight of such compositions.

Soil Release Agent

Polymeric soil release agents useful in the present invention include cellulosic derivatives such as hydroxyether cellulosic polymers, copolymeric blocks of ethylene terephthalate and polyethylene oxide or polypropylene oxide terephthalate, and cationic guar gums, and the like.

The cellulosic derivatives that are functional as soil release agents are commercially available and include hydroxyethers of cellulose such as Methocel ® (Dow) and cationic cellulose ether derivatives such as Polymer JR-124 ®, JR-400 ®, and JR-30M ® (Union Carbide). See also Temple et al. U.S. Pat. No. 3,928,213 issued Dec. 23, 1975, which is incorporated by reference.

Other effective soil release agents are cationic guar gums such as Jaguar Plau ® (Stein Hall) and Gendrive 458 ® (General Mills).

Preferred cellulosic soil release agents for use herein are selected from the group consisting of methyl cellulose; hydroxypropyl methylcellulose; hydroxybutyl methylcellulose; or a mixture thereof, said cellulosic polymer having a viscosity in aqueous solution at 20° C. of 15 to 75,000 centipoise.

A more preferred soil release agent is a copolymer having random blocks of ethylene terephthalate and polyethylene oxide (PEO) terephthalate. More specifically, these polymers are comprised of repeating units of ethylene terephthalate and PEO terephthalate in a mole ratio of ethylene terephthalate units to PEO terephthalate units of from about 25:75 to about 35:65, said PEO terephthalate units containing polyethylene oxide having molecular weights of from about 300 to about 2000. The molecular weight of this polymeric soil release agent is in the range of from about 25,000 to about 55,000. See Hays U.S. Pat. No. 3,959,230 issued May 25, 1976, which is incorporated by reference. See also Basadur U.S. Pat. No. 3,893,929 issued July 8, 1975 (incorporated by reference) which discloses similar copolymers. Surprisingly, it has been found that these polymeric soil release agents balance the distribution of the fabric care agent of the present invention against a broad range of synthetic fabrics such as polyesters, nylons, poly cottons and acrylics. This more uniform distribution of the fabric care agent can result in improved fabric care qualities.

Another preferred polymeric soil release agent is a crystallizable polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000, and the mole ratio of ethylene terephthalate units to polyoxyethylene terephthalate units in the crystallizable polymeric compound is between 2:1 and 6:1. Examples of this polymer include the commercially available material Zelcon ® 5126 (from DuPont) and Milease ® T (from ICI).

The foregoing polymers and methods of their preparation are more fully described in European Patent Application 185,417, Gosselink, published June 25, 1986, which is incorporated herein by reference.

If utilized, these soil release agents will generally comprise from about 0.01% to about 5.0% by weight of the detergent compositions herein, more preferably soil release agents will comprise from about 0.2% to about 3.0% by weight of such compositions.

Clay Soil Removal/Anti-redeposition Agents

The compositions of the present invention can also optionally contain water-soluble ethoxylated amines having clay soil removal and anti-redeposition properties. Granular detergent compositions preferably contain from about 0.01% to about 10.0% by weight of the water-soluble ethoxylated amines; liquid detergent compositions, preferably about 0.01% to about 5%. These compounds are selected from the group consisting of:

(1) ethoxylated monoamines having the formula:

$$(X-L\rightarrow N-(R^2)_2$$

(2) ethoxylated diamines having the formula:

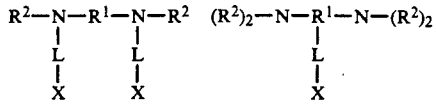

or $$(X-L\rightarrow_2 N-R^1-N-(R^2)_2$$

(3) ethoxylated polyamines having the formula:

$$R^3-[(A^1)_q-(R^4)_t-\overset{R^2}{N}-L-X]_p$$

(4) ethoxylated amine polymers having the general formula:

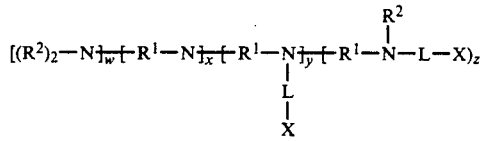

and (5) mixtures thereof; wherein $A^1$ is

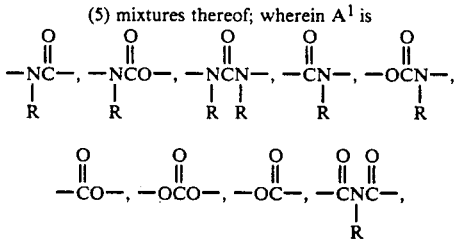

or —O—; R is H or $C_1$–$C_4$ alkyl or hydroxyalkyl; $R^1$ is $C_2$–$C_{12}$ alkylene, hydroxyalkylene, alkenylene, arylene or alkarylene, or a $C_2$–$C_3$ oxyalkylene moiety having from 2 to about 20 oxyalkylene units provided that no O-N bonds are formed; each $R^2$ is $C_1$–$C_4$ or hydroxyalkyl, the moiety —L—X, or two $R^2$ together form the moiety $-(CH_2)_r-A^2-(CH_2)_s-$, wherein $A^2$ is —O— or $-CH_2-$, r is 1 or 2, s is 1 or 2, and r+s is 3 or 4; X is a nonionic group, an anionic group or mixture thereof; $R^3$ is a substituted $C_3$–$C_{12}$ alkyl, hydroxyalkyl, alkenyl, aryl, or alkaryl group having p substitution sites; $R^4$ is $C_1$–$C_{12}$ alkylene, hydroxyalkylene, alkenylene, arylene or alkarylene, or a $C_2$–$C_3$ oxyalkylene moiety having from 2 to about 20 oxyalkylene units provided that no O—O or O—N bonds are formed; L is a hydrophilic chain which contains the polyoxyalkylene moiety $-[(R^5O)_m(CH_2CH_2O)_n]-$, wherein $R^5$ is $C_3$–$C_4$ alkylene or hydroxyalkylene and m and n are numbers such that the moiety $-(CH_2CH_2O)_n-$ comprises at least about 50% by weight of said polyoxyalkylene moiety; for said monoamines, m is from 0 to about 4, and n is at least about 12; for said diamines, m is from 0 to about 3, and n is at least about 6 when $R^1$ is $C_2$–$C_3$ alkylene, hydroxyalkylene, or alkenylene, and at least about 3 when $R^1$ is other than $C_2$–$C_3$ alkylene, hydroxyalkylene or alkenylene; for said polyamines and amine polymers, m is from 0 to about 10 and n is at least about 3; p is from 3 to 8; q is 1 or 0; t is 1 or 0, provided that t is 1 when q is 1; w is 1 or 0; x+y+z is at least 2; and y+z is at least 2. The most preferred soil release and anti-redeposition agent is ethoxylated tetraethylenepentamine. Exemplary ethoxylated amines are further described in Vandermeer U.S. Pat. No. 4,597,898, issued July 1986, incorporated herein by reference. Another group of preferred clay soil removal/anti-redeposition agents are the cationic compounds disclosed in European Patent Application 111,965, Oh and Gosselink, published June 27, 1984, incorporated herein by reference. Other clay soil removal/anti-redeposition agents which can be used include the ethoxylated amine polymers disclosed in European Patent Application 111,984, Gosselink, published June 27, 1984; the zwitterionic polymers disclosed in European Patent Application 112,592, Gosselink, published July 4, 1984; and the amine oxides disclosed in Connor U.S. Pat. No. 4,548,744, issued Oct. 22, 1985, all of which are incorporated herein by reference.

Soil release agents, such as those disclosed in the art to reduce oily staining of polyester fabrics, may also be used in the compositions of the present invention. Nicol et al. U.S. Pat. No. 3,962,152, issued June 8, 1976, incorporated herein by reference, discloses copolymers of ethylene terephthalate and polyethylene oxide terephthalate as soil release agents. Burns et al. U.S. Pat. No. 4,174,305, issued Nov. 13, 1979, incorporated herein by reference, discloses cellulose ether soil release agents.

Enzymes

Enzymes are a preferred optional ingredient and are incorporated in an amount of from about 0.025% to about 2%, preferably from about 0.05% to about 1.5% of the total composition. Preferred proteolytic enzymes should provide a proteolytic activity of at least about 5 Anson units (about 1,000,000 Delft units) per liter, preferably from about 15 to about 70 Anson units per liter, most preferably from about 20 to about 40 Anson units per liter. A proteolytic activity of from about 0.01 to about 0.05 Anson units per gram of product is desirable. Other enzymes, including amylolytic enzymes, are also desirably included in the present compositions.

Suitable proteolytic enzymes include the many species known to be adapted for use in detergent compositions. Commercial enzyme preparations such as Savinase TM and Alcalase TM sold by Novo Industries and Maxatase TM sold by Gist-Brocades, Delft, The Netherlands, are suitable. Other preferred enzyme compositions include those commercially available under the tradenames SP-72 (Esperase TM) manufactured and sold by Novo Industries, A/S, Copenhagen, Denmark and AZ-Protease TM manufactured and sold by Gist-Brocades, Delft, The Netherlands.

Suitable amylases include Rapidase TM sold by Gist-Brocades and Termamyl TM sold by Novo Industries.

A more complete disclosure of suitable enzymes can be found in Place et al. U.S. Pat. No. No. 4,101,457, issued July 18, 1978, and in Hughes U.S. Pat. No. 4,507,219, issued Mar. 26, 1985, both incorporated herein by reference.

Stabilizing System

Preferably, the liquid fabric care or detergent compositions of the present invention contain a stabilizing agent to maintain the fabric care agent uniformly dispersed in the liquid medium. Otherwise, density differences between the insoluble particles and the liquid base detergent can cause eventual particle settling or creaming.

The choice of the stabilizing agent for the present compositions depends upon factors such as the type and level of solvent ingredients in the composition.

Suitable suspending agents include various clay materials, such as montmorillonite clay, quaternized montmorillonite clays (e.g. Bentone TM 14, available from NL Industries), hectorites (e.g., Laponite TM S, available from La Porte), polysaccharide gums (e.g. xanthan gum available from the Kelco Division of Merck & Co., Inc.), any of several long-chain acyl derivative materials or mixtures of such materials; diethanolamide of a long-chain fatty acid (e.g., PEG 3 lauramide), block polymers of ethylene oxide and propylene oxide (such as Pluronic TM F88 offered by BASF Wyandotte), sodium chloride, ammonium xylene sulfonate, sodium sulfate and polyvinyl alcohol. Other suspending agents found useful are alkanol amides of fatty acids, having from about 16 to about 22 carbon atoms, preferably from about 16 to about 18 carbon atoms. Preferred alkanol amides are stearic monoethanolamide, stearic diethanolamide, stearic monoisopropanolamide and stearic monoethanolamide stearate. Other long-chain acyl derivatives include long-chain esters of long-chain alkanol amides (e.g., stearamide DEA distearate, stearamide MEA stearate).

The most preferred suspending agents for use in the present invention are quaternized montmorillonite clay and hectorite clay.

This suspending agent is preferably present at a level of from about 0.1% to about 10.0%, preferably from about 0.5% to about 1.5%.

Bleaching Agents

The compositions of the present invention, particularly the granular detergent compositions, can optionally contain from about 1% to about 20%, preferably about 1% to about 10% of percarboxylic acids bleaching agents or bleaching compositions containing peroxygen bleaches capable of yielding hydrogen peroxide in an aqueous solution and specific bleach activators, hereinafter defined, at specific molar ratios of hydrogen peroxide to bleach activator. These bleaching agents are fully described in Chung et al. U.S. Pat. No. 4,412,934, issued Nov. 1, 1983, and in Hartman U.S. Pat. No. 4,483,781, issued Nov. 20, 1984, both of which are herein incorporated by reference. Such compositions provide extremely effective and efficient surface bleaching of textiles which thereby remove stains and/or soils from the textiles. The compositions are particularly effective at removing dingy soils from textiles. Dingy soils are soils that build up on textiles after numerous cycles of usage and washing and, thus, result in a white textile having a gray tint. These soils tend to be a blend of particulate and greasy materials. The removal of this type of soil is sometimes referred to as "dingy fabric clean up".

The bleaching compositions provide such bleaching over a wide range of bleach solution temperatures. Such bleaching is obtained in bleach solutions wherein the solution temperature is at least about 5° C. Without the bleach activator such peroxygen bleaches would be ineffective and/or impracticable at temperatures below about 60° C.

The Peroxygen Bleaching Compound

The peroxygen bleaching compounds useful herein include those capable of yielding hydrogen peroxide in an aqueous solution. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono- and tetra-hydrate, sodium carbonate peroxyhydrate, sodium pyrophosphate peroxyhydrate, urea peroxyhydrate, and sodium peroxide. Particularly preferred are sodium perborate tetrahydrate and, especially, sodium perborate monohydrate. Sodium perborate monohydrate is especially preferred because it is very stable during storage and yet still dissolves very quickly in the bleaching solution.

Bleaching agents useful herein contain from about 0.1% to about 99.9% and preferably from about 1% to about 60% of these peroxygen bleaches.

The Bleach Activator

Preferred bleach activators incorporated into compositions of the present invention have the general formula:

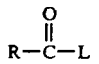

wherein R is an alkyl group containing from about 1 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 4 to about 13.

L can be essentially any suitable leaving group. A leaving group is any group that is displaced from the bleach activator as a consequence of the nucleophilic attack on the bleach activator by the perhydroxide anion. This, the perhydrolysis reaction, results in the formation of the percarboxylic acid. Generally, for a group to be a suitable leaving group it must exert an electron attracting effect. This facilitates the nucleophilic attack by the perhydroxide anion. Leaving groups that exhibit such behavior are those in which their conJugate acid has a $pK_a$ in the range of from about 4 to about 13, preferably from about 7 to about 11 and most preferably from about 8 to about 11.

Preferred bleach activators are those of the above general formula wherein R is as defined in the general formula and L is selected from the group consisting of:

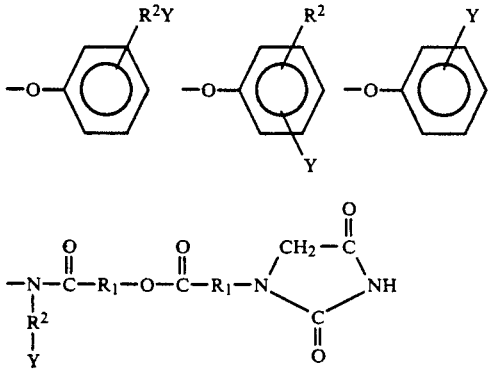

-continued

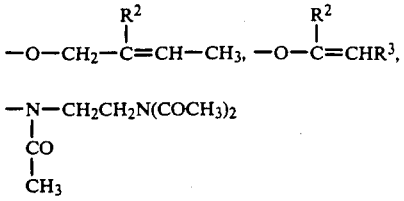

wherein R is as defined above, $R^2$ is an alkyl chain containing from about 1 to about 8 carbon atoms, $R^3$ is H or $R^2$, and Y is H or a solubilizing group. The preferred solubilizing groups are $—SO^-{}_3M^+$, $—COO^-M^+$, $—SO^-{}_4M^+$, $(—N^+R_3{}^4)X^-$ and 0 $—NR_2{}^4$ and most preferably $—SO^-{}_3M^+$ and $—COO^-M^+$ wherein $R^4$ is an alkyl chain containing from about 1 to about 4 carbon atoms, M is a cation which provides solubility to the bleach activator, and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing group should be well dispersed in the bleaching solution in order to assist in their dissolution.

Preferred bleach activators are also those of the above general formula wherein L is as defined in the general formula and R is an alkyl group containing from about 1 to about 12 carbon atoms wherein the longest linear alkyl chain extending from and including the carbonyl carbon contains from about 6 to about 10 carbon atoms.

Even more preferred are bleach activators of the above general formula wherein L is a defined in the general formula and R is a linear alkyl chain containing from about 1 to about 9 and preferably from about 1 to about 8 carbon atoms.

More preferred bleach activators are those of the above general formula wherein R is a linear alkyl chain containing from about 5 to about 9 and preferably from about 6 to about 8 carbon atoms and L is selected from the group consisting of:

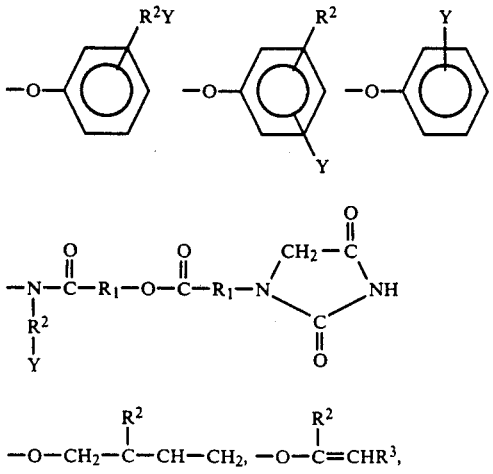

-continued

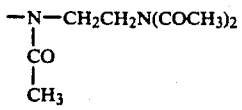

wherein R, $R^2$, $R^3$ and Y are as defined above.

Particularly preferred bleach activators are those of the above general formula wherein R is an alkyl group containing from about 1 to about 12 carbon atoms wherein the longest linear portion of the alkyl chain extending from and including the carbonyl carbon is from about 1 to about 10 carbon atoms and L is selected from the group consisting of:

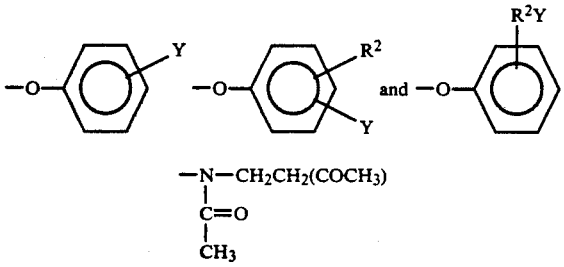

wherein $R^2$ is as defined above and Y is $-SO^-{}_3M^+$ or $-COO^-M^+$ wherein M is as defined above. A particularly preferred bleach activator from the above group is tetraacetyl ethylene diamine which is disclosed in European Patent Application 204,116, Hardy et al., published Dec. 10, 1986 incorporated by reference herein.

Especially preferred bleach activators are those of the above general formula wherein R is a linear alkyl chain containing from about 5 to about 9 and preferably from about 6 to about 8 carbon atoms and L is selected from the group consisting of:

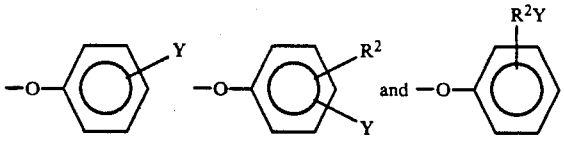

wherein $R^2$ is as defined above and Y is $-SO^-{}_3M^+$ or $-COO^-M^+$ wherein M is as defined above.

The more preferred bleach activators have the formula:

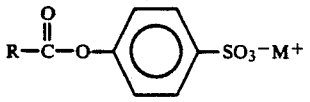

wherein R is a linear or branched alkyl chain containing from about 5 to about 9 and preferably from about 6 to about 8 carbon atoms and M is sodium or potassium. The most preferred bleach activator is sodium nonyl oxybenzene sulfonate. Sodium nonyloxbenzene sulfonate can also be used in combination with any of the above-described bleach activators, particularly tetraacetyl ethylene diamine.

These bleach activators can also be combined with up to 15% of binder materials (relative to the activator) such as nonionic surfactants, polyethylene glycols, fatty acids, anionic surfactants and mixtures thereof Such binding materials are fully set forth in Murphy et al. U.S. Pat. No. 4,486,327, issued Dec. 4, 1984 which is incorporated by reference herein.

Bleaching agents useful herein contain from about 0.1% to about 60% and preferably from about 0.5% to about 40% of these bleach activators.

Percarboxylic Acid Bleaching Agents

Bleaching agents can also comprise percarboxylic acids and salts thereof. Suitable examples of this class of agents include magnesium monoperoxyphthalate hexahydrate, the magnesium salt of meta-chloro perbenzoic acid, nonyl amino-6-oxoperoxysuccinic acid and diperoxydodecanedioic acid. Such bleaching agents are disclosed in Hartman U.S. Pat. No. 4,483,781, issued Nov. 20, 1984, Burns et al. U.S. patent application Ser. No. 740,446, filed June 3, 1985 and also in European Patent Application 0,133,354, Banks et al., published Feb. 20, 1985, both of which are incorporated by reference herein.

Smectite Clay Minerals

A highly preferred optional component of formulations, especially granular detergent compositions, is smectite clay, which serves to provide additional fabric softening performance. The smectite clays particularly useful in the present invention are montmorillonites, saponites, and synthetic hectorites. The clays used herein have particle size which cannot be perceived tactilely. Impalpable clays have particle sizes below about 50 microns.

The clay minerals used to provide fabric conditioning properties in the instant compositions can be described as expandable (swellable), three-layer clays, in which a sheet of aluminum atoms or magnesium atoms lies between two layers of silicone atoms, i.e., aluminosilicates and magnesium silicates, having an ion exchange capacity of at least about 50 meq/100 g. of clay, and preferably at least about 60 meq/100 g. of clay. The term "expandable" as used to describe clays relates to the ability of the layered clay structure to be swollen or expanded on contact with water. The three-layer expandable clays used herein are examples of the clay minerals classified geologically as smectites. Such smectite clays are described in Grim, *Clay Mineralogy* (2nd. Ed.) pp. 77–79 (1968), and in Van Olphen, *An Introduction to Clay Colloid Chemistry,* (2nd. Ed.) pp 64–76 (1977), both of which are incorporated by reference herein.

In general, there are two distinct classes of smectite clays that can be broadly differentiated on the basis of the number of octahedral metal-oxygen arrangements in the central layer for a given number of silicon oxygen atoms in the outer layers. The dioctahedral minerals are primarily trivalent metal ion-based clays and are comprised of the prototype pyrophyllite and the members montmorillonite $(OH)_4Si_{8-y}Al_y(Al_{4-x}Mg_x)O_{20}$, nontronite $(OH)_4Si_{8-y}Al_y(Al_{4-x}Fe_x)O_{20}$, and volchonskoite $(OH)_4Si_{8-y}Al_y(Al_{4-x}Cr_x)O_{20}$, where x has a value of from 0 to about 4.0 and y has a value of from 0 to about 2.0.

The trioctahedral minerals are primarily divalent metal ion based and comprise the prototype talc and the members hectorite $(OH)_4Si_{8-y}Al_y(Mg_{6-x}Li_x)O_{20}$, saponite $(OH)_4Si_{8-y}Al_y(Mg_{6-x}Al_x)O_{20}$, sauconite $(OH)_4Si_{8-y}Al_y(Zn_{6-x}Al_x)O_2$, and vermiculite $(OH)_4Si_{8-y}Al_y(Mg_{6-x}Fe_x)O_{20}$, wherein y has a value of 0 to about 2.0 and x has a value of 0 to about 6.0.

The smectite minerals that are believed to be the most beneficial in fabric care and therefore more preferred when incorporated into detergent compositions are montmorillonites, hectorites and saponites, i.e. minerals of the structure $(OH)_4Si_{8-y}Al_y(Al_{4-x}Mg_x)O_{20}$, $(OH)_4Si_{8-y}Al_y(Mg_{6-x}Li_x)O_{20}$ and $(OH)_4Si_{8-y}Al_yMg_{6-x}Al_xO_{20}$ respectively in which the counter ions are predominantly sodium, potassium or lithium, more preferably sodium or lithium. Especially preferred are beneficated forms of such clays. Benefication of clay removes the various impurities such as quartz thereby providing enhanced fabric care performance. Benefication can take place by any of a number of methods known in the art. Such methods include a conversion of clay into a slip and then passing it through a fine sieve and also flocculating or precipitation of suspended clay particles by the addition of acids or other electro-negatively charged substances. These and other methods of beneficating clay are described in Grinshaw, *The Chemistry and Physics of Clay.* pp 525–27 (1971), which is incorporated by reference herein.

As noted hereinabove, the clay minerals employed in the compositions of the instant invention contain exchangeable cations including, but not limited to, protons, sodium ions, potassium ions, calcium ions, magnesium ions, lithium ions, and the like.

It is customary to distinguish between clays on the basis of one cation predominantly or exclusively adsorbed. For example, a sodium clay is one in which the adsorbed cation is predominantly sodium. As used herein, the term clay, such as a montmorillonite clay, includes all the various exchangeable cation variants of that clay, e.g. sodium montmorillonite, potassium montmorillonite, lithium montmorillonite, magnesium montmorillonite, calcium montmorillonite, etc.

Such adsorbed cations can become involved in exchange reactions with cations present in aqueous solutions. A typical exchange reaction involving a preferred smectite clay (montmorillonite clay) is expressed by the following equation:

$$\text{montmorillonite clay}(Na) + NH_4OH = \text{montmorillonite clay}(NH_4) + NaOH.$$

Since, in the foregoing equilibrium reaction, one equivalent weight of ammonium ion replaces an equivalent weight of sodium, it is customary to measure cation exchange capacity (sometimes termed "base exchange capacity") in terms of milliequivalents per 100 g. of clay (meq/100 g.). The cation exchange capacity of clays can be measured in several ways, including by electrodialysis, by exchange with ammonium ion followed by titration or by a methylene blue procedure, all of which are fully set forth in Grinshaw, *The Chemistry and Physics of Clays.* supra at 264–265, incorporated by reference herein. The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. for kaolinites to about 150 meq/100 g., and greater, for certain smectite clays such as montmorillonites. Montmorillonites, synthetic hectorites and saponites all have exchange capacities greater than about 50 meq/100 g. and are therefore useful in the present invention. Illite clays, although having a three layer structure, are of a nonexpanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrons linked together by octahedral groups of oxygens and hydroxyls containing Al and Mg atoms.

Bentonite is a rock type clay originating from volcanic ash and contains montmorillonite (one of the preferred smectite clays) as its principal clay component. The following table shows that materials commercially available under the name bentonite can have a wide range of cation exchange capacities.

| Bentonite | Supplier | Exchange Capacity (meq/100 g.) |
|---|---|---|
| Brock | Georgia Kaolin Co. USA | 63 |
| Soft Clark | Georgia Kaolin Co. USA | 84 |
| Bentolite L | Georgia Kaolin Co. USA | 68 |
| Clarolite T-60 | Georgia Kaolin Co. USA | 61 |
| Granulare Naturale Bianco | Seven C. Milan Italy | 23 |
| Thixo-Jel #4 | Georgia Kaolin Co. USA | 55 |
| Granular Naturale Normale | Seven C. Milan Italy | 19 |
| Clarsol FB 5 | Ceca Paris France | 12 |
| PDL 1740 | Georgia Kaolin Co. USA | 26 |
| Versuchs Product FFI | Sud-Chemie Munich, Germany | 26 |

Some bentonite clays (i.e., those with cationic exchange capacity above about 50 meq/100 q.) can be used in the detergent compositions of the present invention.

It has been determined that illite, attapulgite, and kaolinite clays, with their relatively low ion exchange capacities, are not useful in the instant compositions. However, the alkali metal montmorillonites, saponites, and hectorites and certain alkaline earth metal varieties of these minerals, such as sodium hectorite, lithium hectorite, potassium hectorite etc., do meet the ion exchange capacity criteria set forth above and have been found to show useful fabric care benefits when incorporated in detergent compositions in accordance with the present invention.

Specific non-limiting examples of commercially-available smectite clay minerals which provide fabric care benefits when incorporated into the detergent compositions of the present invention include:

Sodium Hectorite

Bentone EW
Veegum F
Laponite SP

Sodium Montmorillonite

Brock
Volclay BC
Gelwhite GP
Ben-A-Gel

Sodium Saponite

Barasym NAS 100

Calcium Montmorillonite

Soft Clark
Gelwhite L

Lithium Hectorite

Barasym LIH 200

It is to be recognized that such smectite minerals obtained under the foregoing tradenames can comprise mixtures of the various discrete mineral entities. Such mixtures of the smectite minerals are suitable for use herein.

Within the classes of montmorillonites, synthetic hectorite and saponite clay minerals having a cation exchange capacity of at least about 50 meq/100 g., certain clays are preferred for fabric softening purposes. For example, Gelwhite TM GP is an extremely white form of smectite clay and is therefore preferred when formulating white granular detergent compositions. Volclay TM BC, which is a smectite clay mineral containing at least 3% of iron (expressed as $Fe_2O_3$) in the crystal lattice, and which has a very high ion exchange capacity, is one of the most efficient and effective clays for use in detergent softening composition. Imvite TM K is also satisfactory.

Appropriate clay minerals for use herein can be selected by virtue of the fact that smectites exhibit a true 14% x-ray diffraction pattern. This characteristic pattern, taken in combination with exchange capacity measurements performed in the manner noted above, provides a basis for selecting particular smectite-type minerals for use in the compositions disclosed herein.

The smectite clay materials useful in the present invention are hydrophilic in nature, i.e., they display swelling characteristics in aqueous media. Conversely they do not swell in nonaqueous or predominantly nonaqueous systems.

The clay-containing detergent compositions according to the invention contain up to 35%, preferably from about 2% to about 15%, especially preferably from about 4% to about 12%, by weight of clay.

Other Optional Detergent Ingredients

Other optional ingredients which can be included in detergent compositions of the present invention, in their conventional art-established levels for use (generally from 0 to about 20%), include solvents, hydrotropes, solubilizing agents, suds suppressors, processing aids, soil-suspending agents, corrosion inhibitors, dyes, fillers, optical brighteners, germicides, pH-adjusting agents (monoethanolamine, sodium carbonate, sodium hydroxide, etc.), enzyme-stabilizing agents, bleaches, bleach activators, perfumes, and the like.

Product Formulations

1. Liquid Compositions

Liquid compositions of the present invention can contain water and other solvents. Small quantities of low molecular weight primary or secondary alcohols, exemplified by methanol, ethanol, propanol, and isopropanol, are suitable solvents. Liquid compositions may comprise the ion-pair complex particles as the only fabric care agent, or the ion-pair complex particles may be combined with other fabric care agents. The active components of the liquid composition may primarily be fabric conditioning agents, may include detergent ingredients such as those disclosed herein, and may include other cleaning, conditioning, or other ingredients not specifically listed herein.

With regard to liquid detergent compositions, it is preferred to include monohydric alcohols for solubilizing the surfactant, but polyols containing from about 2 to about 6 carbon atoms and from about 2 to about 6 hydroxy groups can be used and can provide improved enzyme stability (if enzymes are included in the composition). Examples of polyols include propylene glycol, ethylene glycol, glycerine and 1,2-propanediol. Propylene glycol is a particularly preferred alcohol.

The ion-pair complex particles of this invention are well adapted for direct application to fibers or fabrics and as such can be formulated, for example, as aqueous dispersions as the primary or only active fabric conditioning agent without detergent ingredients.

The aqueous dispersion in an aerosol form comprises from about 2% to about 60% of the ion-pair complex particles of the present invention; from about 10% to 50% water; from about 10 to about 30% of a suitable organic solvent; the balance being a suitable propellant. Examples of such propellants are the chlorinated, fluorinated and chlorofluorinated lower molecular weight hydrocarbons. Nitrous oxide, carbon dioxide, isobutane and propane may also be used as propellant gases. These propellants are used at a level sufficient to expel the contents of the container. Suitable organic materials useful as the solvent or a part of a solvent system are as follows: propylene glycol, polyethylene glycol (M.W. 200–600), polypropylene glycol (M.W. 425–2025), glycerine, sorbitol esters, 1,2,6-hexanetriol, diethyl tartrate, butanediol, and mixtures thereof. The balance of the composition comprises a liquid carrier, preferably the carrier is water or a mixture of water and monohydric alcohols.

Other optional components of these liquid conditioning compositions of this type are conventional in nature, and generally comprise from about 0.1% to about 20% by weight of the composition. Such optional components for fabric conditioners include, but are not limited to, colorants, perfumes, bacterial inhibitors, optical brighteners, opacifiers, viscosity modifiers, fabric absorbency boosters, emulsifiers, stabilizers, shrinkage controllers, spotting agents, germicides, fungicides, anticorrosion agents and the like.

The ion-pair complex particle of the present invention are useful as aqueous dispersions added to the wash or rinse.

When it is desired to utilize such ion-pair complex particles for use in through-the-wash (i.e., wash added) domestic laundering, it is necessary that the particles have an average particle diameter as described hereinabove.

The ratios of water and other solvents in the compositions will be determined in part by the resulting state of the fabric care agent. At ambient temperatures, the fabric care agent must be substantially insoluble in the product, and within the particle size specifications heretofore discussed. This will place restrictions upon the selection of solvents and solvent levels in the compositions.

In preferred executions of the invention, the product should desirably be free-flowing across a reasonable temperature range.

The liquid fabric conditioning compositions of the present invention can be prepared by conventional methods.

2. Granular Compositions

Granular compositions of the present invention may comprise the ion-pair complex particles as the only fabric conditioning agent, or the ion-pair complex particles may be combined with other fabric conditioning agents. The active components of the granular composition may primarily be fabric conditioning agents, may include detergent ingredients such as those disclosed herein, and may include cleaning, conditioning, or other ingredients not specifically listed herein.

Granular detergent compositions embodying the present invention can be formed by conventional techniques, i.e., by slurrying the individual components (with the exception of the ion-pair complex) in water and then atomizing and spray-drying the resultant mixture, or by pan or drum agglomeration of the ingredients. The ion-pair complex particles can then be added directly into the composition.

3. Substrate-Released Thru-the-Wash Laundry Articles

Compositions of this invention, both liquid and granular formulations, can also be adapted to a thru-the-wash laundry article which comprises the conditioning agent of the present invention with or without other detergent, fabric care or other laundry actives contained within fabric care- and/or detergent containing articles which release particles of the ion-pair complexes in water. These articles include laminated substrates such as those described in U.S. Pat. No. 4,571,924, issued to Bahrani on Feb. 25, 1986, and U.S. Pat. No. 4,638,907, issued to Behenk et al. on Jan. 27, 1987, which are incorporated by reference herein. Such laminated substrate articles are particularly suitable for granular compositions. Other articles include dissolvable laundry products, such as a dissolvable pouch, which can be used for granular or liquid compositions.

The ion-pair complex particles of the present invention may also comprise a nonsilicone wax in addition to the ion-pair complex, as disclosed in U.S. Ser. No. 061,063, filed June 10, 1987, incorporated herein by reference.

Particles comprising a combination of the ion-pair complex and nonsilicone wax can be formed by mixing the two components in molten form and then forming particles by the methods discussed above. Exemplary nonsilicone waxes include hydrocarbon waxes, such as paraffin wax, and microcrystalline wax. The weight ratio of ion-pair complex to wax is preferably between about 1:10 and about 10:1.

In a laundry method aspect of the invention, typical laundry wash water solutions comprise from about 0.1% to about 2% by weight of the detergent compositions of the invention. Fabrics to be laundered are agitated in these solutions to effect cleaning, stain removal, and fabric care benefits.

The conditioning agents of the invention are particularly suitable for laundry use, but are also suitable as a hair conditioning component in shampoos and hair conditioning compositions.

The foregoing description fully describes the nature of the present invention. The following examples are presented for the purpose of illustrating the invention. The scope of the invention is to be determined by the claims, which follow the examples.

All parts, percentages and ratios herein are by weight unless otherwise specified.

EXAMPLES

The following examples illustrate the present invention. The scope of the present invention is to be defined by the claims which follow. The abbreviations used are:

| Code | Ingredient |
|---|---|
| $C_{13}$HLAS | $C_{13}$ linear alkylbenzene sulfonic acid |
| $C_{11.4}$HLAS | $C_{11.4}$ linear alkylbenzene sulfonic acid |
| NI 23-6.5T | $C_{12-13}$ alkyl polyethoxylate (6.5 T) available as Neodol 23-6.5T from Shell T = stripped of lower ethoxylated fractions and fatty alcohol |
| $C_{12-13}$ GI.3 | $C_{12-13}$ alkyl glycoside |
| $C_{12}$DMAO | $C_{12}$ dimethyl amine oxide |
| TKPP | tetrapotassium pyrophosphate |
| NI 25-8T | $C_{12}$–$C_{15}$ alkyl polyethoxylate (8T) |
| stabilizer | Bentone-14 quaternized montmorillonite clay obtained from NL Industries |
| OBS | sodium nonyl oxybenzene sulfonate |
| DTPA | sodium diethylenetriaminepentaacetate |
| PBI | sodium perborate monohydrate |
| PPT | poly(terephthalate propyleneglycol ester) ethoxylated with about 30 moles of ethylene oxide |
| STPP | sodium tripolyphosphate (contains 4% pyrophosphate) |
| TEPA-$E_{15-18}$ | tetraethylene pentaimine ethoxylated with 15–18 moles (avg.) of ethylene oxide at each hydrogen site on each nitrogen |
| DTA | ditallow amine (hydrogenated) |
| DSA | distearyl amine |
| AES | alkylethoxylated sulfate |
| TAS | sodium tallow alkyl sulfate |
| Clay | sodium montmorillonite clay |
| Misc | can include enzymes, enzyme stabilizers, other phase stabilizers, perfumes, brighteners, dyes, water, other solvents, pH adjusting agents (e.g., monoethanolamine, diethanolamine, triethanolamine, KOH, NaOH, $NH_4OH$ and salts, suds suppressor) dispersant, and anti-redeposition agents. |

EXAMPLE I

The following liquid detergent composition is prepared by adding the components to a mixing tank in the order listed with continuous mixing.

| Detergent Base Components | Weight % of Final Product |
|---|---|
| $C_{11.4}$HLAS | 17.2 |
| NI 23-6.5T | 8.7 |
| propanediol | 14.49 |
| monoethanolamine | 1.93 |
| $C_{8-15}$ alkenyl succinate | 11.21 |
| sodium citrate | 3.48 |
| DTPA | 0.29 |
| TEPA-$E_{15-18}$ | 1.45 |
| PPT | 0.97 |
| protease enzyme (2.0 AV/g) | 0.58 |
| amylase enzyme (375 AM V/g) | 0.30 |
| stabilizer | 0.72 |
| miscellaneous and water | balance to 94.5% |

The ion-pair complex is formed by combining a 1:1 molar ratio of hydrogenated ditallow amine (available from Sherex Chemical Corp., Dublin, Ohio as Adogen® 240) and linear $C_5$ alkyl benzene sulfonic acid. The resulting mixture is heated to 70° C. with agitation in a beaker to give a homogeneous fluid. This mixture is then cooled, with stirring, down to room temperature. The resulting ion-pair complex mixture is frozen by liquid nitrogen and then ground in an Oster® blender pulsematic Model 16 for about 10 seconds. The ground particles are then sieved through a 500 micron screen. The average particle size of the fraction will typically range from about 60 microns to about 150 microns (as determined by, for example, a Malvern® 2600 particle size analyzer). While still frozen, 5.5 parts of the particles are then added to 94.5 parts of the detergent base and the resulting detergent composition is mixed by a high shear mechanical dispersing probe (e.g. a Polytron Model PT 10/35 obtained from Brinkman Instruments) in order to insure even distribution of the particles and to further reduce the average particle size diameter to about 80 microns.

Substantially similar results are obtained when the hydrogenated ditallow amine-$C_5$ LAS ion-pair complex is replaced, in whole or in part, with an equivalent amount of hydrogenated or unhydrogenated ditallow amine complexed with a linear $C_1$–$C_4$ alkyl benzene sulfonate (LAS), hydrogenated or unhydrogenated ditallow methyl amine complexed with a $C_1$–$C_5$ LAS, dipalmityl amine complexed with a $C_1$–$C_5$ LAS, dipalmityl methyl amine complexed with a $C_1$–$C_5$ LAS, distearyl amine complexed with a $C_1$–$C_5$ LAS, distearyl methyl amine complexed with a $C_1$–$C_5$ LAS, diarachidyl amine complexed with a $C_1$–$C_5$ LAS, diarachidyl methyl amine complexed with a $C_1$–$C_5$ LAS, palmityl stearyl amine complexed with a $C_1$–$C_5$ LAS, palmityl stearyl methyl amine complexed with a $C_1$–$C_5$ LAS, palmityl arachidyl amine complexed with a $C_1$–$C_5$ LAS, palmityl arachidyl methyl amine complexed with a $C_1$–$C_5$ LAS, stearyl arachidyl amine complexed with a $C_1$–$C_5$ LAS, stearyl arachidyl methyl amine complexed with a $C_1$–$C_5$ LAS, ditallow amine (hydrogenated or unhydrogenated) complexed with a benzene sulfonate, ditallow methyl amine (hydrogenated or unhydrogenated) complexed with a benzene sulfonate, dipalmityl amine complexed with a benzene sulfonate, dipalmityl methyl amine complexed with a benzene sulfonate, distearyl amine complexed with a benzene sulfonate, distearyl methyl amine complexed with a benzene sulfonate, diarachidyl amine complexed with a benzene sulfonate, diarachidyl methyl amine complexed with a benzene sulfonate, palmityl stearyl amine complexed with a benzene sulfonate, palmityl stearyl methyl amine complexed with a benzene sulfonate, palmityl arachidyl amine complexed with a benzene sulfonate, palmityl arachidyl methyl amine complexed with a benzene sulfonate, stearyl arachidyl amine complexed with a benzene sulfonate, stearyl arachidyl methyl amine complexed with a benzene sulfonate, and mixtures of these ion-pair complexes.

Preferred are complexes formed from the combination of distearyl amine and ditallow amine (hydrogenated) complexed with $C_1$–$C_5$ LAS, or benzene sulfonates. More preferred are those complexes formed from distearyl or ditallow amine (hydrogenated) complexed with a $C_1$–$C_3$ LAS, or benzene sulfonate. Most preferred are complexes formed from distearyl or ditallow amine (hydrogenated) complexed with a $C_3$ LAS. Instead of flash freezing, the comelt can alternately be added directly into the detergent base and formed into particles by high shear mixing. When the ion-pair complex is formed from a comelt of amine and a $C_1$–$C_3$ LAS or benzene sulfonate, the comelt can be prilled to form the particles instead of being ground or sheared as described herein. The prilled particle can be mixed into the detergent base. Prilling is exemplified in Example XIII.

Substantially similar results are also obtained when the $C_{11.4}$HLAS anionic surfactant component of Example 1 is replaced, in whole or in part, with an equivalent amount of other anionic surfactants, including, but not limited to, $C_8$–$C_{18}$ alkyl benzene sulfonates and $C_{12}$–$C_{18}$ paraffin sulfonates, and mixtures thereof.

EXAMPLES II-XII

The following liquid detergent compositions are representative of the present invention and are made as described above in Exmple I.

| | II | III | IV | V | VI | VII | VIII | IX | X | XI | XII |
|---|---|---|---|---|---|---|---|---|---|---|---|
| $C_{13}$ HLAS | 18 | 18 | — | — | — | — | — | 8 | — | — | — |
| $C_{11.4}$ HLAS | — | — | — | 18 | — | 18 | — | — | — | — | 18 |
| $C_{14-16}$ paraffin sulfonate | — | — | — | — | — | 12 | 25 | — | — | — | — |
| $C_{12-18}$ paraffin sulfonate | — | — | — | — | — | — | — | — | 20 | 25 | — |
| $C_{14-15}$ alkyl polyethoxylate (2.25) sulfuric acid | — | — | — | — | 5 | — | — | 5 | — | — | — |
| NI 23-6.5T | 9 | 5 | 17 | 7 | 22 | — | — | 5 | — | — | — |
| NI 25-8T | — | — | — | — | — | — | — | — | — | — | 7 |
| $C_{12-13}$ G1.3 | — | 4 | — | 2 | — | — | 5 | — | — | — | — |
| $C_{12}$DMAO | — | — | — | 2 | — | 2 | — | — | — | — | — |
| TKPP | 12 | — | — | — | — | — | 10 | — | 10 | — | — |
| $C_{12-14}$ fatty acid | — | 11 | — | 12 | — | — | — | 11 | — | — | — |
| oleic acid | 2 | 3 | — | — | — | — | — | — | — | — | — |
| $C_{8-15}$ alkenyl succinate | — | — | — | — | — | 15 | 15 | — | — | — | — |
| sodium citrate | — | — | — | 4 | 1 | 2 | — | 4 | 12 | 10 | 10 |
| propanediol | 5 | 15 | — | 15 | — | 4 | — | 8 | — | — | — |
| ethanol | 8 | 0 | 7 | — | 7 | 7 | 7 | 4 | 5 | 7 | — |
| PPT | 1 | 1 | — | 1 | — | 1 | 1 | 1 | 1 | 1 | 1 |
| protease enzyme | 0.6 | 0.6 | 0.6 | 0.6 | 0.6 | 0.6 | 0.6 | 0.6 | 0.6 | 0.6 | 0.6 |
| amylase enzyme | 0.3 | 0.3 | 0.3 | 0.3 | 0.3 | 0.3 | 0.3 | 0.3 | 0.3 | 0.3 | 0.3 |
| stabilizer | 0.75 | 0.5 | 0.75 | 0.5 | 0.75 | 0.75 | 0.75 | 0.75 | 0.75 | 0.75 | 0.75 |

-continued

| | II | III | IV | V | VI | VII | VIII | IX | X | XI | XII |
|---|---|---|---|---|---|---|---|---|---|---|---|
| water and miscellaneous | | | | | Balance up to 95% | | | | | | |

The amine-anionic compound ion-pair is added in an amount to total 5% of the total weight of the composition. The ion-pair complex added is any of the $C_1$–$C_5$ LAS compounds or benzene sulfonates complexed with distearyl amine and hydrogenated ditallow amine.

These compositions give excellent cleaning as well as excellent static control and softening benefits (without impairing cleaning).

EXAMPLE XIII

This example demonstrates the synthesis and generation of ditallow amine-linear $C_3$ alkylbenzene sulfonate ion-pair complex particles by a nozzle injection method.

An ion-pair complex is formed by combining a 1:1 molar ratio of hydrogenated ditallow amine (available from Sherex Corporation, Dublin, Ohio as Adogen® 240) and cumene sulfonic acid. The acid is added to a 70° C. to 150° C. melt of the amine with agitation to give a homogeneous fluid. The mixture is kept well mixed by recirculation and hydraulically forced through a heated nozzle to form particles of the complex which have mean diameters of between about 50 and about 150 microns. Alternately, the mixture can be forced through the nozzle by air injection.

Substantially similar results can be obtained when the ion-pair complex is replaced, in whole or in part, with an equivalent amount of ditallow amine (hydrogenated or unhydrogenated), complexed with a linear $C_1$ or $C_2$ alkylbenzene sulfonate (LAS) or benzene sulfonate, ditallow methyl (hydrogenated or unhydrogenated) amine complexed with a $C_1$–$C_3$ LAS or benzene sulfonate, dipalmityl amine complexed with a $C_1$–$C_3$ LAS or benzene sulfonate, dipalmityl methyl amine complexed with a $C_1$–$C_3$ LAS or benzene sulfonate, distearyl amine complexed with a $C_1$–$C_3$ LAS or benzene sulfonate, distearyl methyl amine complexed with a $C_1$–$C_3$ LAS or benzene sulfonate, diarachidyl amine complexed with a $C_1$–$C_3$ LAS or benzene sulfonate, diarachidyl methyl amine complexed with a $C_1$–$C_3$ LAS or benzene sulfonate, palmityl stearyl amine complexed with a $C_1$–$C_3$ LAS or benzene sulfonate, palmityl stearyl methyl amine complexed with a $C_1$–$C_3$ LAS or benzene sulfonate, palmityl arachidyl amine complexed with a $C_1$–$C_3$ LAS or benzene sulfonate, palmityl arachidyl methyl amine complexed with a $C_1$–$C_3$ LAS or benzene sulfonate, stearyl arachidyl amine complexed with a $C_1$–$C_3$ LAS or benzene sulfonate, stearyl arachidyl methyl amine complexed with a $C_1$–$C_3$ LAS or benzene sulfonate, and mixtures thereof.

These particles can be used in place of the particles disclosed in Examples I–XII with substantially similar results by forming the particles as discussed above and then mixing them with the other liquid detergent components. These particles may also be incorporated into a variety of other delivery systems such as granular detergent compositions (wherein the particles are preferably agglomerated before being incorporated into the composition), liquid or granular fabric care compositions in the substantial absence of non-fabric conditioning agents, including aqueous dispersions useful for direct application to fabrics. All such compositions can be added to the laundry before or during the wash stage of fabric laundering without significantly impairing cleaning performance, while still providing excellent fabric conditioning. The particles can also be applied to fabrics subsequent to the wash stage, such as during the rinse stage or during drying, and thereby provide effective fabric conditioning.

EXAMPLE XIV

A granular laundry detergent composition of the present invention is made as follows:

The following components are combined and then spray-dried in a conventional manner to form a detergent premix.

| Ingredient | Percent Weight |
|---|---|
| Sodium $C_{13}$ LAS | 10.2% |
| Sodium $C_{14}$–$C_{15}$ alkyl sulfate | 10.2% |
| Sodium tripolyphosphate | 47.3% |
| NI 23-6.5T | 0.5% |
| DTPA | 0.5% |
| Sodium silicate (1.6 r) | 7.2% |
| Sodium sulfate | 15.3% |
| Water and Minors and Misc. ingredients | Balance to 100% (premix wt. basis) |

Added to 76 parts (weight basis) of this premix are (on a weight basis): 11.5 parts sodium carbonate; 7.0 parts hydrogenated ditallow amine $C_3$LAS ion-pair particles prepared as described in Example XIII; and 5.5 parts sodium montmorillonite clay. The detergent composition is thoroughly mixed to ensure even distribution of the components.

The resulting detergent composition exhibits excellent cleaning and excellent fabric care benefits such as softness and static control.

The ion-pair particles can also be agglomerated using any of a variety of binding agents and techniques. Binding agents must dissolve quickly in the wash liquor. Suitable examples of binding agents include water, or water-soluble salts such as sulfates, carbonates, Dextrin TM glue, or phosphates. Agglomeration of the ion-pair particles prior to their addition to the granular detergent premix can minimize segregation of the particles from the remainder of the detergent composition.

Substantially similar results can be obtained when the hydrogenated ditallow amine $C_3$ LAS ion-pair particles are replaced with any of the other ion-pair complex particles of Example XIII, or mixtures thereof.

EXAMPLES XV–XX

The following granular detergent compositions are representative of the present invention and are made as described above in Example XIV, except that the detergent of Example XX is made by pan or drum agglomeration rather than spray-drying.

| | XV | XVI | XVII | XVIII | IXX | XX |
|---|---|---|---|---|---|---|
| $NaC_{13}LAS$ | 8.4 | 6.6 | 9.4 | 13.7 | 3.8 | — |
| $C_{45}AS$ | 8.4 | 6.6 | 9.4 | — | — | — |
| NI 23-6.5T | 0.3 | 1.0 | 0.9 | 0.3 | 0.2 | 20.0 |
| AES | — | — | — | — | 6.0 | — |
| STPP | 38.3 | 29.3 | — | 27.7 | 36.8 | 50.0 |
| TAS | — | — | — | — | 6.0 | — |
| Sodium Silicate (1.6 r) | 5.9 | 10.4 | 1.7 | 5.5 | 5.2 | 10.0 |
| Sodium Carbonate | 12.4 | 15.4 | 4.7 | 11.4 | 11.5 | 1.0 |
| Aluminosilicate | — | — | 23.0 | — | — | — |
| DTPA | 0.4 | 1.1 | — | — | — | — |
| Sodium Sulfate | 12.6 | 0.9 | 33.3 | 22.6 | 16.1 | — |
| PB1 | — | 5.1 | — | — | — | — |
| OBS | — | 6.9 | — | — | — | — |
| Clay | — | 4.9 | 5.8 | 5.7 | 5.8 | 5.8 |
| DTA-$C_3$LAS | 5.2 | 4.1 | 4.9 | 4.8 | 4.9 | 4.9 |
| Misc. Ingredients: | | | Balance to 100% | | | |

These compositions give excellent cleaning as well as excellent static control and softening benefits (without impairing cleaning). Substantially similar results can be obtained when the DTA-$C_3$LAS particles are replaced with any of the other ion-pair complex particles of Example XIII, or mixtures thereof.

EXAMPLE XXI

A granular fabric care composition is provided in a laminated substrate. One part of ditallow amine (hydrogenated)-$C_3$LAS ion-pair particles of about 60 to about 100 microns in mean diameter are made as described in Example XIII. These particles are mixed with about one part of a smectite clay. The ion-pair/clay mixture is contained in a laminated substrate article having single or multiple pouches such as described in U.S. Pat. No. 4,571,924. The laminated substrate article can be placed in the wash cycle, in the presence of a detergent. Optionally detergent ingredients, such as, but not limited to, those described in Examples XIV through XX can be mixed with the ion-pair complex particles. Also optionally, such detergent ingredients can be provided in or more pouches of the substrate article and the ion-pair particles can be provided one or more other pouches of the substrate article. The substrate article releases the mixture upon agitation during the wash cycle. Alternately, the mixture of clay and ion-pair particles can be added to the wash cycle without use of the substrate article. In each of these applications, excellent fabric conditioning without substantial adverse effects upon cleaning performance is obtained.

What is claimed is:

1. A conditioning agent for static control and softening of fabrics comprising water-insoluble particles having an average diameter of from about 40 microns to about 300 microns, said particles comprising a protonated alkyl amine-anionic compound ion-pair complex having the formula:

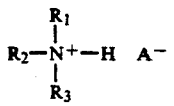

wherein each $R_1$ and $R_2$ independently is $C_{12}$–$C_{20}$ alkyl or alkenyl, each $R_3$ is H or $CH_3$, and $A^-$ is an anionic compound selected from the group consisting of linear $C_1$–$C_5$ alkyl benzene sulfonates and benzene sulfonates, and mixtures of said ion-pair complexes.

2. A conditioning agent as in claim 1, wherein $R_3$ is H.

3. A conditioning agent as in claim 1, wherein said average particle diameter is greater than about 50 microns and less than about 250 microns.

4. A conditioning agent as in claim 3, wherein said average particle size is greater than about 60 microns and less than about 150 microns.

5. A conditioning agent as in claim 3, wherein the amine is selected from the group consisting of hydrogenated ditallow amine, unhydrogenated ditallow amine, hydrogenated ditallow methyl amine, unhydrogenated ditallow methyl amine, dipalmityl amine, dipalmityl methyl amine, distearyl amine, distearyl methyl amine, diarachidyl amine, diarachidyl methyl amine, palmityl stearyl amine, palmityl stearyl methyl amine, palmityl arachidyl amine, palmityl arachidyl methyl amine, stearyl arachidyl amine, and stearyl arachidyl methyl amine, and mixtures thereof.

6. A conditioning agent as in claim 4, wherein the amine is selected from the group consisting of hydrogenated ditallow amine, unhydrogenated ditallow amine, unhydrogenated ditallow methyl amine, unhydrogenated ditallow methyl amine, dipalmityl amine, dipalmityl methyl amine, distearyl amine, distearyl methyl amine, diarachidyl amine, diarachidyl methyl amine, palmityl stearyl amine, palmityl stearyl methyl amine, palmityl arachidyl amine, palmityl arachidyl methyl amine, stearyl arachidyl amine, and stearyl arachidyl methyl amine, and mixtures thereof.

7. A conditioning agent as in claim 6 wherein the ion-pair complex is selected from the group consisting of

- hydrogenated ditallow amine complexed with a linear $C_1$–$C_3$ alkyl benzene sulfonate,
- hydrogenated ditallow methyl amine complexed with a linear $C_1$–$C_3$ alkyl benzene sulfonate,
- unhydrogenated ditallow amine complexed with a $C_1$–$C_3$ alkyl benzene sulfonate,
- unhydrogenated ditallow methyl amine complexed with a $C_1$–$C_3$ alkyl benzene sulfonate,
- dipalmityl amine complexed with a linear $C_1$–$C_3$ alkyl benzene sulfonate,
- dipalmityl methyl amine complexed with a linear $C_1$–$C_3$ alkyl benzene sulfonate,
- distearyl amine complexed with a linear $C_1$–$C_3$ alkyl benzene sulfonate,
- distearyl methyl amine complexed with a linear $C_1$–$C_3$ alkyl benzene sulfonate,
- diarachidyl amine complexed with a linear $C_1$–$C_3$ alkyl benzene sulfonate,
- diarachidyl methyl amine complexed with a linear $C_1$–$C_3$ alkyl benzene sulfonate,
- palmityl stearyl amine complexed with a linear $C_1$–$C_3$ alkyl benzene sulfonate,
- palmityl stearyl methyl amine complexed with a linear $C_1$–$C_3$ alkyl benzene sulfonate,
- palmityl arachidyl amine complexed with a linear $C_1$–$C_3$ alkyl benzene sulfonate,
- palmityl arachidyl methyl amine complexed with a linear $C_1$–$C_3$ alkyl benzene sulfonate,
- stearyl arachidyl amine complexed with a linear $C_1$–$C_3$ alkyl benzene sulfonate,
- stearyl arachidyl methyl amine complexed with a linear $C_1$–$C_3$ alkyl benzene sulfonate,
- ditallow amine (hydrogenated or unhydrogenated) complexed with a benzene sulfonate,
- ditallow methyl amine (hydrogenated or unhydrogenated) complexed with a benzene sulfonate, dipalmityl amine complexed with a benzene sulfonate,
dipalmityl methyl amine complexed with a benzene sulfonate,
distearyl amine complexed with a benzene sulfonate,
distearyl methyl amine complexed with a benzene sulfonate,
diarachidyl amine complexed with a benzene sulfonate,
diarachidyl methyl amine complexed with a benzene sulfonate,
palmityl stearyl amine complexed with a benzene sulfonate,
palmityl stearyl methyl amine complexed with a benzene sulfonate,
palmityl arachidyl amine complexed with a benzene sulfonate,
palmityl arachidyl methyl amine complexed with a benzene sulfonate,
stearyl arachidyl amine complexed with a benzene sulfonate,
stearyl arachidyl methyl amine complexed with a benzene sulfonate, and mixtures thereof.

8. A conditioning agent as in claim 7 wherein the anionic compound of the ion-pair complex comprises a linear $C_1$–$C_3$ alkyl benzene sulfonate or a benzene sulfonate and the amine is a distearyl amine, or a ditallow amine, and mixtures thereof.

9. A detergent composition comprising from about 0.1% to about 20% of the conditioning agent of claim 1 and from about 1% to about 98% of a water-soluble detergent surfactant selected from the group consisting of cationic surfactants, nonionic surfactants, zwitterionic surfactants, amphoteric surfactants, and anionic surfactants, wherein the quantity of said detergent surfactant is exclusive of the quantity of anionic compound present in said ion-pair complex.

10. A detergent composition as in claim 9, wherein $R_3$ is H.

11. A detergent composition as in claim 9, wherein said average particle diameter is greater than about 50 microns and less than about 250 microns.

12. A detergent composition as in claim 11, wherein said average particle size is greater than about 60 microns and less than about 150 microns.

13. A detergent composition as in claim 9, wherein $A^-$ is selected from the group consisting of $C_1$–$C_3$ linear alkyl benzene sulfonates and benzene sulfonates and mixtures thereof.

14. A detergent composition as in claim 11, wherein $A^-$ is selected from the group consisting of $C_1$–$C_3$ linear alkyl benzene sulfonates and benzene sulfonates and mixtures thereof.

15. A detergent composition as in claim 12, wherein $A^-$ is selected from the group consisting of $C_1$–$C_3$ linear alkyl benzene sulfonates and benzene sulfonates and mixtures thereof.

16. A detergent composition as in claim 9, wherein the alkyl amine is selected from the group consisting of hydrogenated ditallow amine, unhydrogenated ditallow amine, hydrogenated ditallow methyl amine, unhydrogenated ditallow methyl amine, dipalmityl amine, dipalmityl methyl amine, distearyl amine, distearyl methyl amine, diarachidyl amine, diarachidyl methyl amine, palmityl stearyl amine, palmityl stearyl methyl amine, palmityl arachidyl amine, palmityl arachidyl methyl amine, stearyl arachidyl amine, and stearyl arachidyl methyl amine, and mixtures thereof.

17. A detergent composition as in claim 14, wherein the amine is selected from the group consisting of hydrogenated ditallow amine, unhydrogenated ditallow amine, hydrogenated ditallow methyl amine, unhydrogenated ditallow methyl amine, dipalmityl amine, dipalmityl methyl amine, distearyl amine, distearyl methyl amine, diarachidyl amine, diarachidyl methyl amine, palmityl stearyl amine, palmityl stearyl methyl amine, palmityl arachidyl amine, palmityl arachidyl methyl amine, stearyl arachidyl amine, and stearyl arachidyl methyl amine, and mixtures thereof.

18. A detergent composition as in claim 15, wherein the amine is selected from the group consisting of hydrogenated ditallow amine, unhydrogenated ditallow amine, hydrogenated ditallow methyl amine, unhydrogenated ditallow methyl amine, dipalmityl amine, dipalmityl methyl amine, distearyl amine, distearyl methyl amine, diarachidyl amine, diarachidyl methyl amine, palmityl stearyl amine, palmityl stearyl methyl amine, palmityl arachidyl amine, palmityl arachidyl methyl amine, stearyl arachidyl amine, and stearyl arachidyl methyl amine, and mixtures thereof.

19. A detergent composition as in claim 18 wherein the ion-pair complex is selected from the group consisting of hydrogenated ditallow amine complexed with a linear $C_1$–$C_3$ alkyl benzene sulfonate,
hydrogenated ditallow methyl amine complexed with a linear $C_1$–$C_3$ alkyl benzene sulfonate,
unhydrogenated ditallow amine complexed with a $C_1$–$C_3$ alkyl benzene sulfonate,
unhydrogenated ditallow methyl amine complexed with a $C_1$–$C_3$ alkyl benzene sulfonate,
dipalmityl amine complexed with a linear $C_1$–$C_3$ alkyl benzene sulfonate,
dipalmityl methyl amine complexed with a linear $C_1$–$C_3$ alkyl benzene sulfonate,
distearyl amine complexed with a linear $C_1$–$C_3$ alkyl benzene sulfonate,
distearyl methyl amine complexed with a linear $C_1$–$C_3$ alkyl benzene sulfonate,
diarachidyl amine complexed with a linear $C_1$–$C_3$ alkyl benzene sulfonate,
diarachidyl methyl amine complexed with a linear $C_1$–$C_3$ alkyl benzene sulfonate,
palmityl stearyl amine complexed with a linear $C_1$–$C_3$ alkyl benzene sulfonate,
palmityl stearyl methyl amine complexed with a linear $C_1$–$C_3$ alkyl benzene sulfonate,
palmityl arachidyl amine complexed with a linear $C_1$–$C_3$ alkyl benzene sulfonate,
palmityl arachidyl methyl amine complexed with a linear $C_1$–$C_3$ alkyl benzene sulfonate,
stearyl arachidyl amine complexed with a linear $C_1$–$C_3$ alkyl benzene sulfonate,
stearyl arachidyl methyl amine complexed with a linear $C_1$–$C_3$ alkyl benzene sulfonate,
ditallow amine (hydrogenated or unhydrogenated) complexed with a benzene sulfonate,
ditallow methyl amine (hydrogenated or unhydrogenated) complexed with a benzene sulfonate,
dipalmityl amine complexed with a benzene sulfonate,
dipalmityl methyl amine complexed with a benzene sulfonate,
distearyl amine complexed with a benzene sulfonate,
distearyl methyl amine complexed with a benzene sulfonate, diarachidyl amine complexed with a benzene sulfonate, diarachidyl methyl amine complexed with a benzene sulfonate, palmityl stearyl amine complexed with a benzene sulfonate, palmityl stearyl methyl amine complexed with a benzene sulfonate, palmityl arachidyl amine complexed with a benzene sulfonate, palmityl arachidyl methyl amine complexed with a benzene sulfonate, stearyl arachidyl amine complexed with a benzene sulfonate, stearyl arachidyl methyl amine complexed with a benzene sulfonate, and mixtures thereof.

20. A detergent composition according to claim 17 wherein the detergent surfactant is selected from the group consisting of anionic surfactants, nonionic surfactants, cationic surfactants and mixtures thereof.

21. A detergent composition according to claim 20 which comprises from about 0.1% to about 10.0% of the ion-pair complex.

22. A detergent composition according to claim 21 which comprises from about 10% to about 60% of the detergent surfactant and composition according to claim 22 additionally comprising from about 5% to about 80% of a detergency builder.

23. A detergent composition according to claim 22 which additionally comprises a liquid carrier and from about 5% to about 50% of a detergency builder.

24. A detergent composition according to claim 22 wherein said composition is a granular detergent and additionally comprises from about 10% to about 80% of a detergency builder.

25. A detergent composition according to claim 23 wherein the builder component is selected from the group consisting of polyacetates, alkenyl succinates, carbonates, $C_{10}$ to $C_{18}$ alkyl monocarboxylic acids, polycarboxylic acids, polymeric carboxylates, polyphosphonic acids, alkali metals, ammonium and substituted ammonium salts thereof, and mixtures thereof.

26. A detergent composition according to claim 24 wherein the builder component is selected from the group consisting of inorganic phosphates, water-insoluble sodium aluminosilicates, silicates, carbonates, $C_{10}$–$C_{18}$ alkyl monocarboxylic acids, polycarboxylic acids, polymeric carboxylates, polyphosphonic acids, alkali metal, ammonium or substituted ammonium salts thereof, and mixtures thereof.

27. A detergency composition according to claim 24 which further comprises from about 2% to about 15% of a smectite clay softener.

28. A detergent composition according to claim 23 additionally comprising from about 0.1% to about 10% of a chelating agent, from about 0.1% to about 3.0% of the composition.

29. A detergent composition according to claim 27 additionally comprising from about 0.1% to about 10% of a chelating agent.

30. A detergent composition according to claim 28 which further comprises from about 0.025% to about 2% of an enzyme.

31. A detergent composition according to claim 29 which further comprises from about 0.025% to about 2% of an enzyme.

32. A detergent composition according to claim 30 which further comprises from about 0.01% to about 5.0% of a clay soil removal and anti-redeposition agent, from about 0.01% to about 5.0% of a soil release agent, and from about 0.1% to about 10.0% of a stabilizing agent.

33. A detergent composition according to claim 31 which further comprises from about 0.01% to about 5.0% of a clay soil removal and anti-redeposition agent, and from about 0.01% to about 5.0% of a soil release agent.

34. A detergent composition according to claim 33, further comprising from about 1% to about 20% of a bleaching agent.

35. A conditioning composition comprising the conditioning agent of claim 1 and a smectite clay softener.

36. A laundry product comprising the composition of claim 1 contained by means for releasing said composition in aqueous solution.

37. A method for conditioning fabrics comprising the steps of agitating said fabrics in an aqueous solution containing the conditioning agent of claim 1 and a detergent composition.

38. A method for laundering fabrics comprising the agitation of said fabrics in an aqueous solution containing from about 0.1% to about 2% of the composition of claim 9.

* * * * *

UNITED STATES PATENT AND TRADEMARK OFFICE

CERTIFICATE OF CORRECTION

PATENT NO. : 5,019,280

DATED : May 28, 1991

INVENTOR(S) : Debra Sue Caswell, Mark Hsiang-Kuen Mao, Robert Mermelstein, Ellen Schmidt-Baker

It is certified that error appears in the above-identified patent and that said Letters Patent is hereby corrected as shown below:

Column 38, line 22, "unhydrogenated" should read --hydrogenated--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*